US006764239B2

(12) United States Patent
Kim

(10) Patent No.: US 6,764,239 B2
(45) Date of Patent: Jul. 20, 2004

(54) HAND-HELD MULTIPURPOSE CASING WITH STRUCTURE FOR REVERSIBLY EXTENDING FUNCTIONAL TIPPED DEVICE

(76) Inventor: Joung Chul Kim, 178-10, Nae-dong, Ojung-ku, Bucheon-si, Kyunggi-do 421-160 (KR)

( * ) Notice: Subject to any disclaimer, the term of this patent is extended or adjusted under 35 U.S.C. 154(b) by 0 days.

(21) Appl. No.: 10/305,937

(22) Filed: Nov. 29, 2002

(65) Prior Publication Data

US 2003/0077103 A1 Apr. 24, 2003

Related U.S. Application Data

(60) Division of application No. 09/693,846, filed on Oct. 23, 2000, now Pat. No. 6,497,524, which is a continuation-in-part of application No. 09/456,522, filed on Dec. 8, 1999, now abandoned.

(30) Foreign Application Priority Data

Oct. 25, 1999 (KR) ..... 1999-46282

(51) Int. Cl.[7] ..... B43K 5/16

(52) U.S. Cl. ..... 401/108; 401/107; 401/116; 15/146; 15/184

(58) Field of Search ..... 401/107, 108, 401/115, 116, 117, 99, 268, 29, 68; 15/146, 159.1, 171, 184

(56) References Cited

U.S. PATENT DOCUMENTS

| | | | |
|---|---|---|---|
| 3,525,573 | A | 8/1970 | Fend |
| 4,311,402 | A | 1/1982 | Brown |
| 4,368,746 | A | 1/1983 | Spatz |
| 4,618,280 | A | 10/1986 | Kageyama |
| 4,640,637 | A | 2/1987 | Winthrop |
| 4,902,152 | A | 2/1990 | Seidler |
| 5,067,836 | A | 11/1991 | Khan |
| 5,397,195 | A | 3/1995 | Goncalves |
| 6,033,141 | A | 3/2000 | Blaustein et al. |

FOREIGN PATENT DOCUMENTS

| | | |
|---|---|---|
| JP | 50-146774 | 12/1975 |
| JP | 51-1165 | 1/1976 |
| JP | 51-31956 | 3/1976 |
| JP | 51-143576 | 11/1976 |
| JP | 52-369 | 1/1977 |
| JP | 56-39890 | 9/1981 |
| JP | 3-42081 | 6/1991 |

*Primary Examiner*—David J. Walczak

(57) ABSTRACT

A hand-held multipurpose casing, with a functional tipped device housed within the casing so as to be linearly and reversibly extendible relative to the casing. This casing has a cylinder-type or screw-type actuating unit designed to reversibly extend the functional tipped device. The screw-type actuating unit has two spiral screw engagements, with opposite spiral directions. In an embodiment, the hand-held multipurpose casing has a front barrel, a middle barrel, a rear barrel, and a functional tipped device holder having a functional tipped device at its front tip and housed within the casing. A cap is fixedly mounted to the rear end of the rear barrel, with two holding slots formed on the front end portion of the external surface of the cap at diametrically opposite positions. A screw-type actuating unit movably engages with both the functional tipped device holder and the cap through two spiral screw-type engagements with opposite spiral directions. The above unit thus primarily converts an axial movement of the cap into a rotating action of a rotatable rod and secondarily converts the rotating action of the rotatable rod into an axial movement of the functional tipped device holder.

14 Claims, 36 Drawing Sheets

HAND-HELD MULTIPURPOSE CASING WITH STRUCTURE FOR REVERSIBLY EXTENDING FUNCTIONAL TIPPED DEVICE

CROSS-REFERENCE TO RELATED APPLICATIONS

This application is a divisional application and claims priority of U.S. Ser. No. 09/693,846, filed Oct. 23, 2000, now U.S. Pat. No. 6,497,524, which is a continuation-in-part application of U.S. application Ser. No. 09/456,522, filed Dec. 8, 1999, now abandoned, under 35 U.S.C. §120 and of Korean patent application 1999-46282, filed Oct. 25, 1999, under 35 U.S.C. §119, the contents of the foregoing being incorporated herein by reference.

BACKGROUND OF THE INVENTION

1. Field of the Invention

The present invention relates to a hand-held multipurpose casing provided with a unit for reversibly extending a functional tipped device housed within the casing, for example, a ballpoint pen cartridge or a makeup brush, and, more particularly, to a hand-held multipurpose casing having a cylinder-type or screw-type actuating unit capable of reversibly extending such a functional tipped device, the casing also having an automatically operated protective cover for the functional tipped device.

2. Description of the Related Art

A variety of makeup brushes, such as loose powder brushes, fan brushes, lip brushes, mascara brushes, eyeliner brushes, or brow brushes, have been used by women, and actors or other performers.

Most conventional makeup brushes are typically provided with manually removable protective caps for allowing users to conveniently use and store the makeup brushes. Such a conventional makeup brush comprises a hand-held casing, including a threaded rod housed within the casing and reversibly extending a brush from the casing by an action of the threaded bar or the threaded rod relative to the casing.

However, the caps have to be removed from the casings when it is desired to use the makeup brushes, and so it is inconvenient to users. In addition, the caps may be carelessly lost and force the users to pay money for the purchase of new makeup brushes.

It is thus necessary to provide a structurally improved makeup brush, with a protective cover being set within the casing of the brush so as to save the user from the inconvenience of losing a conventional removable cap.

SUMMARY OF THE INVENTION

Accordingly, the present invention has been made keeping in mind the above problems occurring in the prior art, and an object of the present invention is to provide a handheld multipurpose casing, which is preferably used as a makeup brush casing and has an automatically operated protective cover firmly set within the casing and used for protecting the functional tipped device, for example, a makeup brush, housed within the casing, thus preventing a careless loss of the protective cover and being convenient for a user.

Another object of the present invention is to provide a hand-held multipurpose casing, which is designed to be adjustable in its length as desired, thus being more conveniently usable in comparison with conventional makeup brush casings having fixed lengths.

A further object of the present invention is to provide a hand-held multipurpose casing, which is designed to have a cylinder-type actuating unit capable of reversibly extending a functional tipped device housed within the casing and reducing the number of parts of the casing, thus simplifying a production process and improving productivity while producing such casings.

A still further object of the present invention is to provide a hand-held multipurpose casing, which is preferably used as a casing for writing instruments or makeup brushes.

Still another object of the present invention is to provide a hand-held multipurpose casing, which is preferably used as a casing for painting brushes.

In order to accomplish the above object, the present invention provides a hand-held multipurpose casing comprising a front barrel, a middle barrel and a rear barrel, with a functional tipped device housed within the casing so as to be linearly and reversibly extendible relative to the casing. The casing has a cylinder-type or screw-type actuating unit designed to reversibly extend the functional tipped device. In such a case, the screw-type actuating unit has two spiral screw engagements, with opposite spiral directions.

In an embodiment, the hand-held multipurpose casing, comprising a front barrel, a middle barrel fixedly fitted into the rear end portion of the front barrel, a rear barrel movably fitted over the rear end portion of the middle barrel so as to be axially movable on the middle barrel, a functional tipped device holder having a functional tipped device at its front tip and housed within the casing so as to be axially movable within the casing in response to an axial movement of the rear barrel, thus extending or retracting the functional tipped device from or into the front opening of the front barrel, further comprising, a cap fixedly mounted to the rear end of the rear barrel, with two holding slots formed on the front end portion of the external surface of the cap at diametrically opposite positions, and a screw-type actuating unit movably engaging with both the functional tipped device holder and the cap through two spiral screw-type engagements with opposite spiral directions, the unit primarily converting an axial movement of the cap into a rotating action of a rotatable rod and secondarily converting the rotating action of the rotatable rod into an axial movement of the functional tipped device holder, thus extending or retracting the functional tipped device from or into the front opening of the front barrel.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
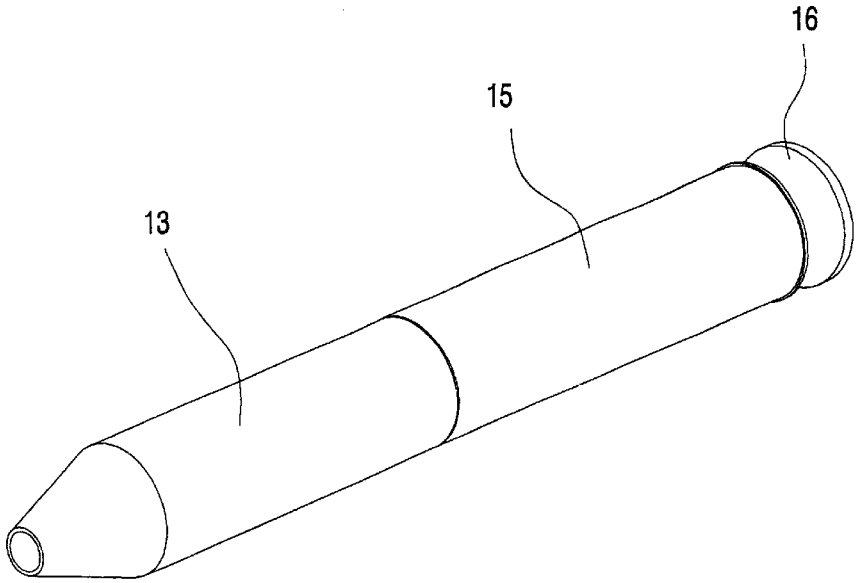
FIG. 1 is a perspective view showing the profile of a hand-held multipurpose casing, having a screw-type actuating unit and used as a makeup brush casing, in accordance with the primary embodiment of the present invention.
Figure 2:
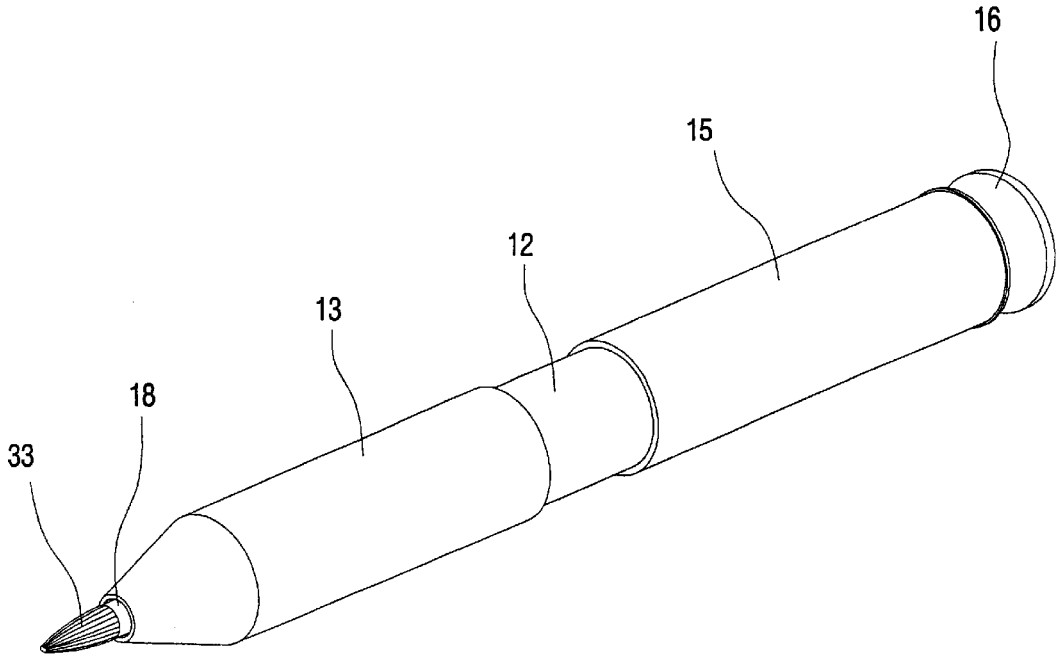
FIG. 2 is a perspective view, showing an operation of the hand-held multipurpose casing of FIG. 1.
Figure 3:
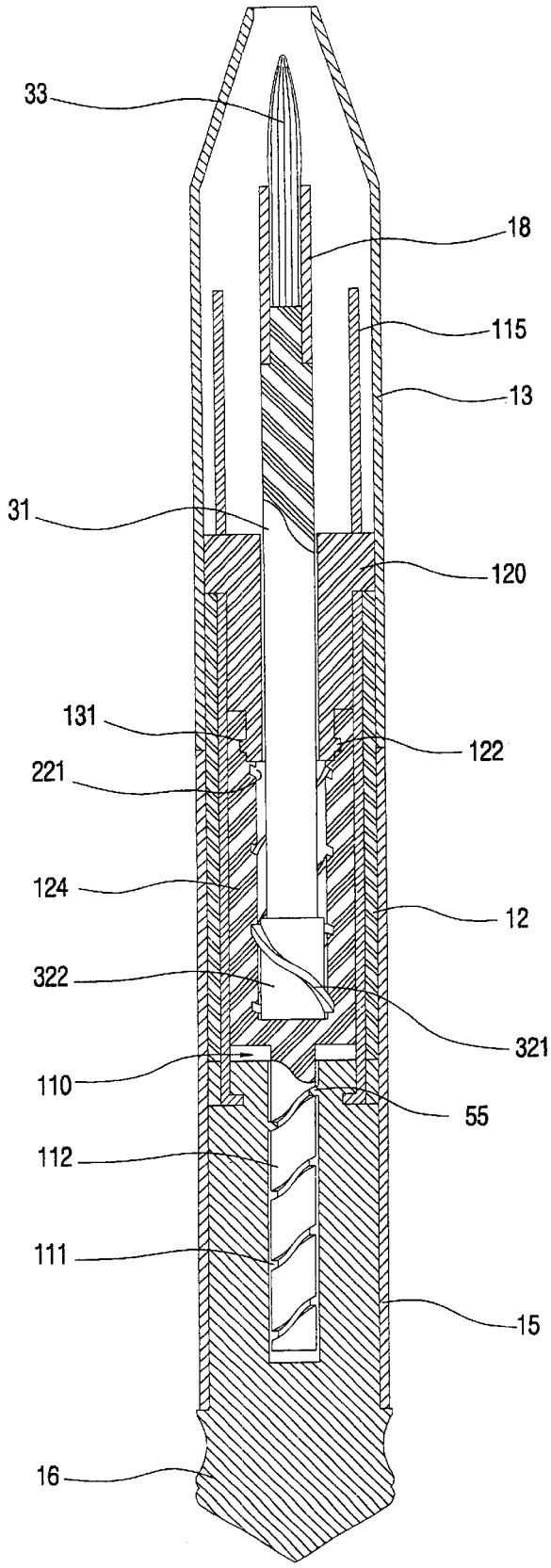
FIG. 3 is a sectional view of the hand-held multipurpose casing of FIG. 1.
Figure 4:
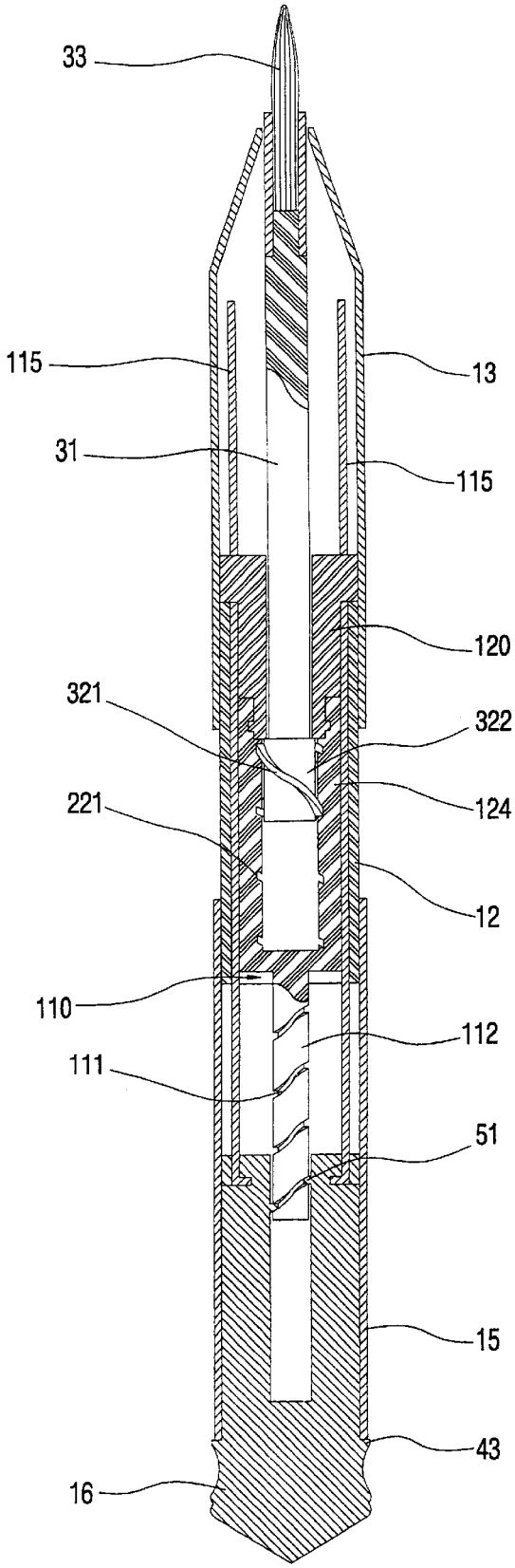
FIG. 4 is a sectional view, showing the operation of the hand-held multipurpose casing of FIG. 3.
Figure 5:
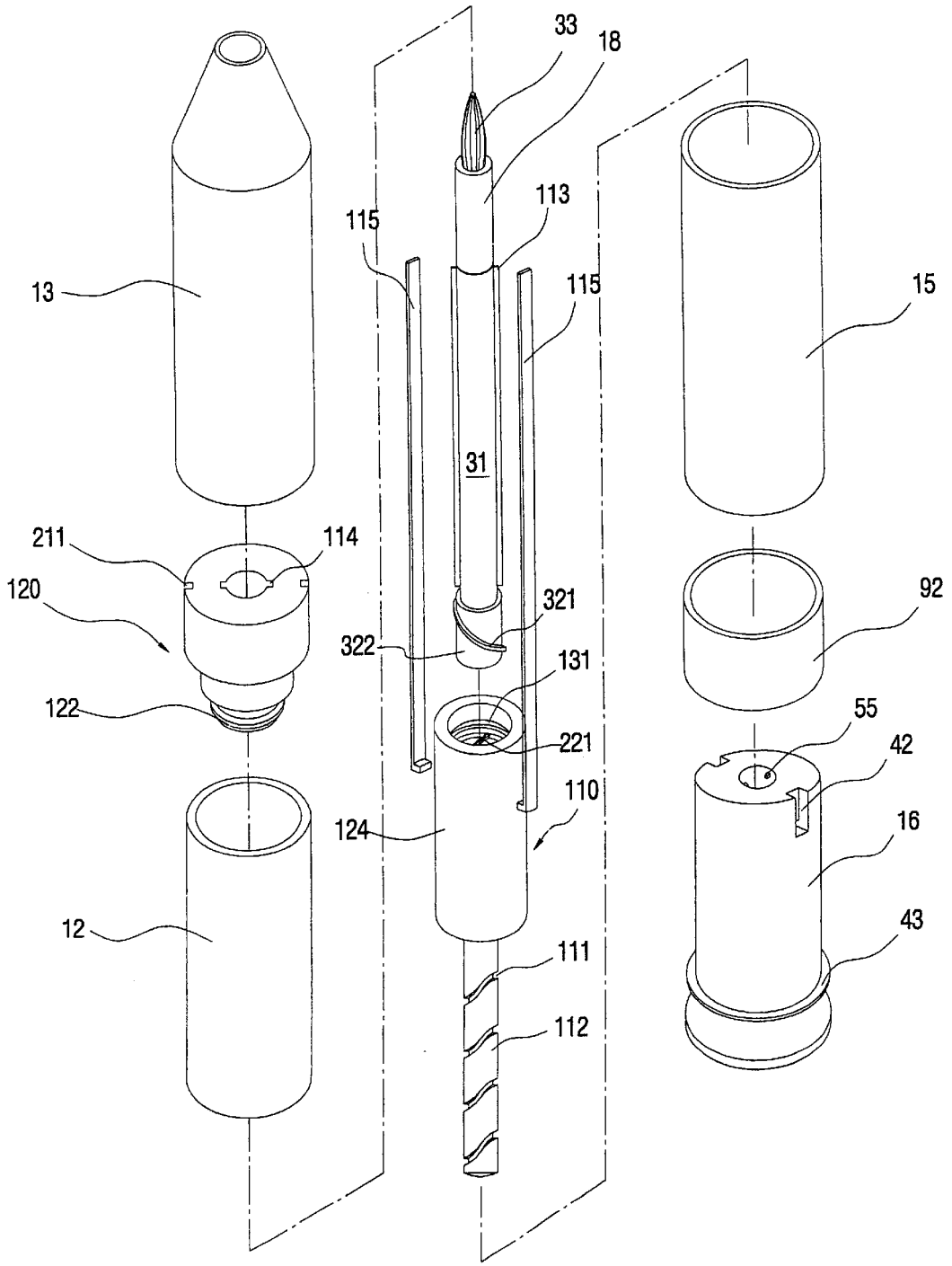
FIG. 5 is an exploded perspective view of the hand-held multipurpose casing of FIG. 1.

FIG. 1 is a perspective view showing the profile of a hand-held multipurpose casing, having a screw-type actuating unit and used as a makeup brush casing, in accordance with the primary embodiment of the present invention. FIG. 2 is a perspective view, showing an operation of the hand-held multipurpose casing of FIG. 1. FIG. 3 is a sectional view of the handheld multipurpose casing of FIG. 1. FIG. 4 is a sectional view, showing the operation of the handheld multipurpose casing of FIG. 3. FIG. 5 is an exploded perspective view of the hand-held multipurpose casing of FIG. 1.

As shown in FIGS. 1 and 2, the hand-held multipurpose casing according to the primary embodiment of the present invention comprises a hollow front barrel 13, having a cylindrical shape with a conical front end, a hollow middle barrel 12 having a cylindrical shape, and a hollow rear barrel 15. A cap 16 is fitted into the rear end of the cylindrical rear barrel 15. The multipurpose casing of this invention houses a screw-type actuating unit used for projecting or retracting a makeup brush 33 relative to the casing.

The rear barrel 15 is movably fitted over the rear end portion of the middle barrel 12 so as to be axially slidable on the middle barrel 12 in opposite directions as desired.

When the rear barrel 15 is axially moved rearward on the middle barrel 12, a thrust rod 31, housed within the casing while centrally extending through the casing, is axially moved forward. Therefore, a makeup brush 33, set at the front end of the rod 31, projects from the front opening of the front barrel 13 to the outside of the casing.

The construction and operation of the above hand-held multipurpose casing of FIGS. 1 and 2 will be described in detail herein below with reference to FIGS. 3 to 5.

As shown in FIGS. 3 to 5, the screw-type actuating unit, housed within the multipurpose casing according to the primary embodiment, comprises a rotatable rod 110, a packing plug 120, a thrust rod 31, two guide bars 115, and a brush holder 18. In the above actuating unit, the rotatable rod 110 consists of a cup-shaped cylindrical seat 124 integrated with the front end of a longitudinal actuating part 112 having an external spiral thread 111. On the other hand, the cup-shaped cylindrical seat 124 has an internal spiral thread 221 on its internal surface, with an annular fitting groove 131 formed at the front portion of said internal surface. The packing plug 120 is a centrally and axially holed member, with two guide slots 211 being axially formed on the external surface of the plug 120 at diametrically opposite positions. A fitting ring 122 is formed on the external surface of the packing plug 120 at a rear portion. This fitting ring 122 engages with the fitting groove 131 of the rotatable rod 110, thus accomplishing a desired engagement of the packing plug 120 with the rotatable rod 110. Two guide grooves 114 are axially formed on the internal surface of the holed plug 120 at diametrically opposite positions. On the other hand, the thrust rod 31 has a cylindrical boss 322 at its rear end portion, with an external spiral thread 321 being formed on the external surface of the boss 322. The above thrust rod 31 also has two axial guide rails 113 on its external surface at diametrically opposite positions so as to movably engage with the guide grooves 114 of the packing plug 120. The thrust rod 31 is inserted into the cylindrical seat 124 of the rotatable rod 110 and is axially movable in accordance with a rotating action of the rotatable rod 110 due to the movable engagement of its external thread 321 with the internal thread 221 of the rotatable rod 110. The two guide bars 115 are mounted to two holding slots 42 of the cap 16 at their rear ends and axially extend forward along each side of the thrust rod 31. In such a case, the two guide bars 115 are placed around the thrust rod 31 at diametrically opposite positions, and pass through the two guide slots 211 of the packing plug 120. The above guide bars 115 are used for guiding a linear axial movement of the thrust rod 31. The brush holder 18 is mounted to the front end of the thrust rod 31 and holds the makeup brush 33. The cap 16 has a central hole closed at its rear end, with two guide projections 55 being formed on the internal surface of the cap 16 at diametrically opposite positions. The two guide projections 55 of the cap 16 movably engage with the external thread 111 formed on the longitudinal actuating part 112 of the rotatable rod 110. The cap 16 also has the two holding slots 42 at diametrically opposite positions on its external surface and holds the two guide bars 115 at the two holding slots 42. The above cap 16 also has an annular support seat 43 at the rear portion of its external surface. On the other hand, the hollow front barrel 13 has a cylindrical shape with a conical front end. The hollow middle barrel 12, having a cylindrical shape, is firmly fitted into the rear end of the front barrel 13 and houses both the packing plug 120 and the front and middle portion of the rotatable rod 110 therein. The hollow rear barrel 15 is movably fitted over the middle and rear portion of the middle barrel 12 at its front portion, and is firmly fitted over the cap 16 at its rear portion with the rear end of the rear barrel 15 being firmly seated on the annular support seat 43 of the cap 16. Due to the firm engagement of the rear barrel 15 with the cap 16, the rear barrel 15 is movable along with the cap 16.

In the above actuating unit, the spiral direction of the external thread 321 of the thrust rod 31 is opposite to that of the external thread 111 of the rotatable rod 110.

The guide projections 55, formed on the internal surface of the cap 16, movably engage with the external thread 111 formed on the longitudinal actuating part 112 of the rotatable rod 110. Due to such a movable engagement of the projections 55 with the external thread 111, the rotatable rod 110 is rotated when the rear barrel 15 with the cap 16 is axially moved relative to the middle barrel 12. Such a rotating action of the rotatable rod 110 creates an axial movement of the thrust rod 31 within the casing due to a movable engagement of the internal spiral thread 221 of the rotatable rod 110 with the external spiral thread 321 of the thrust rod 31, thus finally allowing the makeup brush 33 to be projected from or retracted into the front hole of the front barrel 13.

The fitting ring 122, formed on the external surface of the packing plug 120 at the rear portion, engages with the fitting groove 131 of the rotatable rod 110, thus holding the axial position of the rotatable rod 110 within the casing. Therefore, the axial movement of the rear barrel 15 relative to the middle barrel 12 is completely converted into a rotating action of the rotatable rod 110.

In addition, the packing plug 120 varies in its diameter in such a way that the diameter of the rear portion of the plug 120 having the fitting ring 122 is smaller than that of the front portion of the plug 120. Therefore, it is possible to desirably reduce the frictional force between the fitting ring 122 of the plug 120 and the fitting groove 131 of the rotatable rod 110 during an axial movement of the thrust rod 31 within the packing plug 120.

The cap 16 has a U-shaped cross-section when cutting the cap 16 in an axial direction. In the cap 16, the two guide projections 55 are formed on the internal surface at diametrically opposite positions, and movably engage with the external spiral thread 111 formed on the longitudinal actuating part 112 of the rotatable rod 110. In addition, when the rear barrel 15 is integrated with the cap 16, the rear end of barrel 15 is firmly seated on the annular support seat 43 of the cap 16. The cap 16 is movable along with the rear barrel 15.

The two holding slots 42 are formed on the front end portion of the external surface of the cap 16 at diametrically opposite positions. On the other hand, the two guide bars 115 are held by the two holding slots 42 of the cap 16 at their rear ends and axially extend forward along each side of the thrust rod 31 while coming into close contact with the internal surface of the middle barrel 12. The two guide bars 115 guide a linear axial movement of the thrust rod 31, thus finally allowing the makeup brush 33 to be smoothly projected from or retracted into the front opening of the front barrel 13.

In the present invention, the cap 16 may be preferably made of metal. However, it should be understood that the cap 16 may be also preferably made of plastic, rubber or silicon in addition to metal. Such a plastic, rubber or silicon cap 16 is light and allows a user to feel a soft surface while using the casing.

The front barrel 13 has a hollow cylindrical shape with a conical front end. This barrel 13 is holed at the tip of the conical front end, thus allowing the makeup brush 33 to be projected from or retracted into the casing. The front barrel 13 fixedly receives the front end portion of the middle barrel 12.

The middle barrel 12, having a hollow cylindrical shape, is firmly fitted into the rear end of the front barrel 13.

The outer diameter of the rear portion of the middle barrel 12 is sufficiently smaller than the inner diameter of the rear barrel 15 as to allow the rear barrel 15 to smoothly move relative to the middle barrel 12 during an axial movement of the rear barrel 15. In such a case, the front portion of the rear barrel 15, fitted over the rear portion of the middle barrel 12, is not fixed to the middle barrel 12, but is movable relative to the middle barrel 12 even though it comes into close contact with the external surface of the middle barrel 12.

When the makeup brush 33 is fully projected from the front opening of the casing, the external surface of the middle barrel 12 is exposed to the atmosphere. However, the external surface of the middle barrel 12 is completely covered by both the front barrel 13 and the rear barrel 15 when the makeup brush 33 is fully retracted into the casing.

Figure 18:
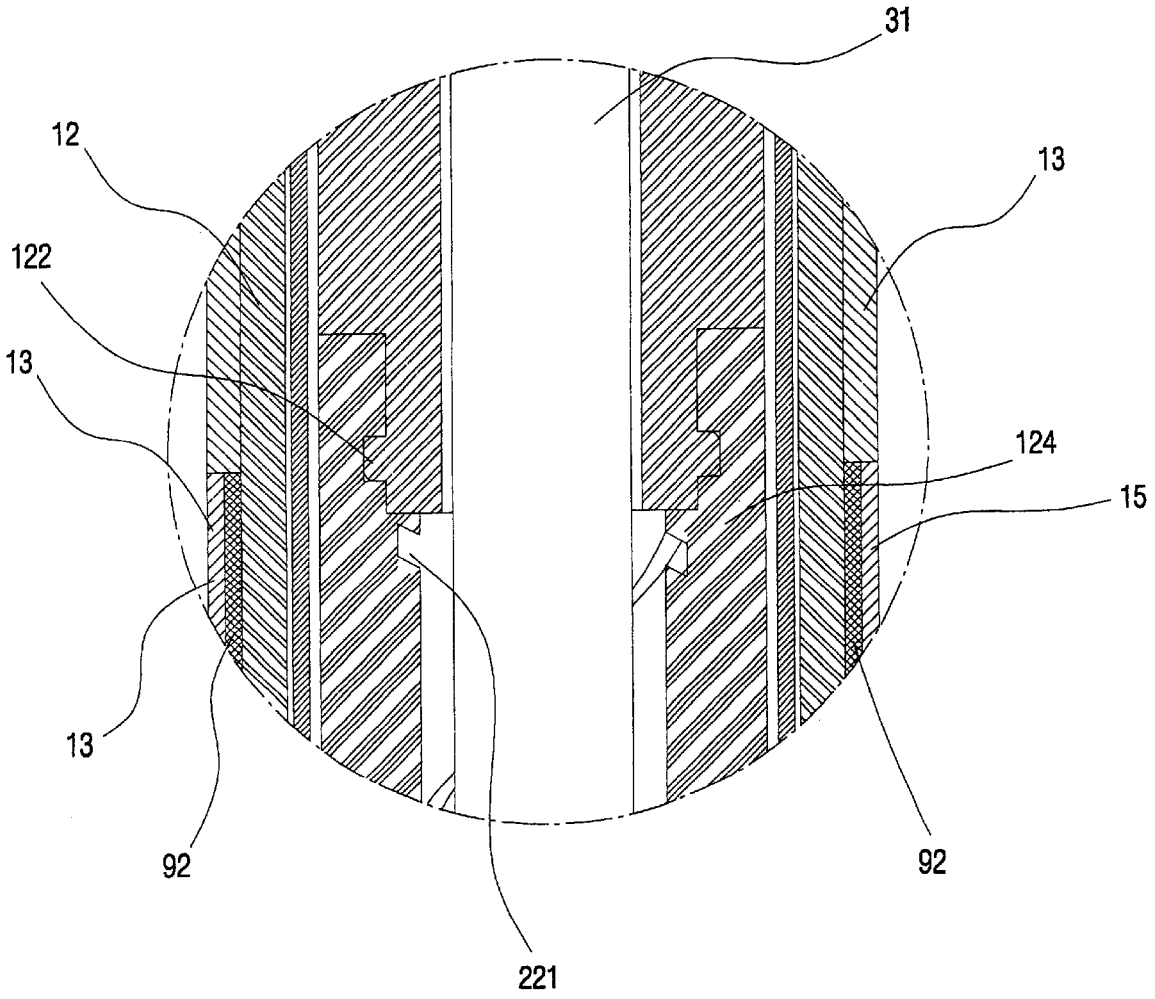
FIG. 18 is a sectional view of the portion "A" of FIG. 17.

A cylindrical slider 92 is set between the middle and rear barrels 12 and 15 as shown in FIG. 18. This slider 92 comes into contact with the rear end of the front barrel 13 when the rear barrel 15 is moved fully forward on the middle barrel 12 so as to completely cover the middle barrel 12.

Due to the above slider 92 set between the middle and rear barrels 12 and 15, the external surface of the middle barrel 12 is protected from frictional damage, such as scratching, during an axial movement of the rear barrel 15 on the middle barrel 12.

The cylindrical slider 92 is also preferably chromed, thus being effectively protected from frictional damage during an axial movement of the rear barrel 15 on the middle barrel 12.

In the multipurpose casing of this invention, the makeup brush 33, such as a loose powder brush, a fan brush, a lip brush, a mascara brush, an eyeliner brush, or a brow brush, is held on the front tip of the brush holder 18 mounted to the front end of the thrust rod 31. The thrust rod 31 has the cylindrical boss 322 at its rear end portion, with the external spiral thread 321 being formed on the external surface of the boss 322. When the above thrust rod 31 is coupled to the cylindrical seat 124 of the rotatable rod 110, the external thread 321 of the thrust rod 31 movably engages with the internal thread 221 of the rotatable rod 110.

When it is desired to project the brush 33 from the front opening of the casing so as to use the brush 33, the rear barrel 15 having the cap 16 is moved backward on the middle barrel 12 from the front barrel 13 as shown in FIG. 4 while gripping the front and rear barrels 13 and 15 with two hands of a user. Therefore, the rotatable rod 110, movably engaging with the cap 16 through a screw-type engagement, is rotated by the backward movement of the rear barrel 15. Due to such a rotating action of the rotatable rod 110, the thrust rod 31 is moved forward since the external spiral thread 321, formed at cylindrical boss 322 of the thrust rod 31, movably engages with the internal spiral thread 221 formed at the cylindrical seat 124 of the rotatable rod 110. The makeup brush 33 is fully projected from the front opening of the casing, thus allowing the user to use the brush 33.

On the other hand, when it is desired to retract the brush 33 into the front opening of the casing after using the brush 33, the rear barrel 15 is fully moved forward on the middle barrel 12 until the rear barrel 15 completely covers the middle barrel 12. In such a case, the front and rear barrels 13 and 15 are gripped with two hands of the user. When the rear barrel 15 is moved forward as described above, the thrust rod 31 is moved backward within the casing, and so the makeup brush 33 is fully retracted into the front barrel 13 of the casing, thus being stored within the casing.

Of course, it is also possible to press the cap 16 against a support surface, such as the top surface of desk, to fully retract the brush 33 into the casing. In such a case, the retraction of the makeup brush 33 into the casing can be accomplished by using one hand.

When the rear barrel 15 is moved backward on the middle barrel 12 to project the brush 33 from the casing, the cap 16 is moved along with the rear barrel 15 in the same direction since the cap 16 is integrated with the barrel 15. In such a case, the external surface of the middle barrel 12 is exposed to the atmosphere, with the length of the casing being increased to accomplish a maximum length. However, when the rear barrel 15 is moved forward on the middle barrel 12 to fully cover the middle barrel 12 and to fully retract the brush 33 into the casing, the length of the casing is reduced to accomplish a minimum length.

Figure 6:
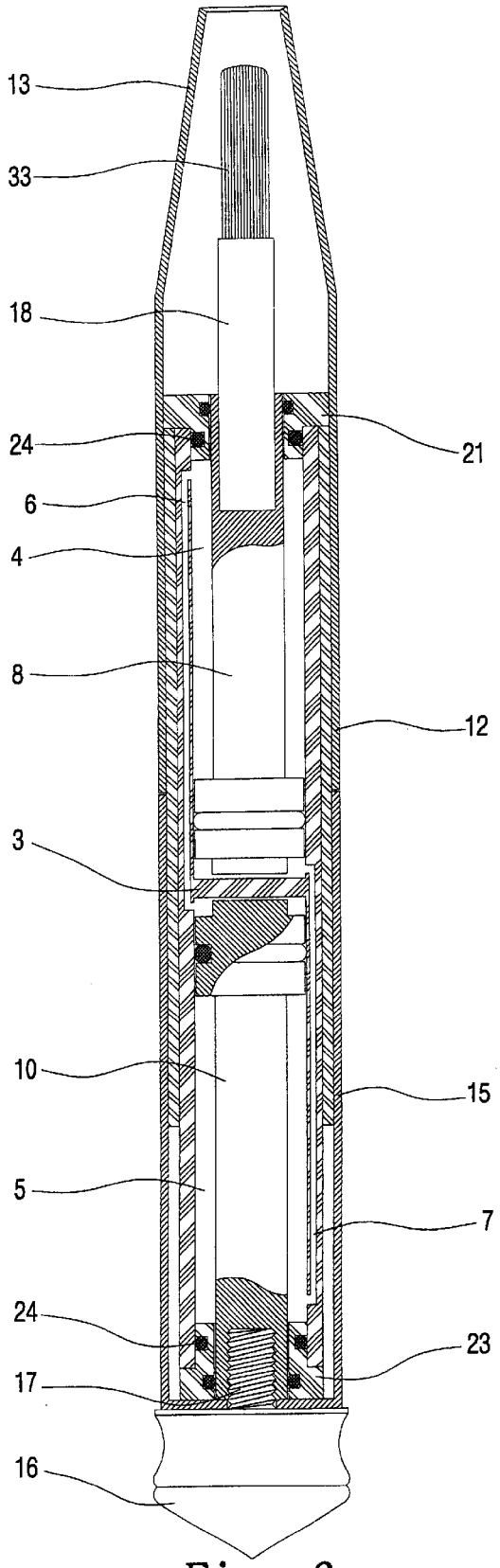
FIG. 6 is a sectional view of a hand-held multipurpose casing, having a cylinder-type actuating unit and used as a makeup brush casing, in accordance with the second embodiment of the present invention.
Figure 7:
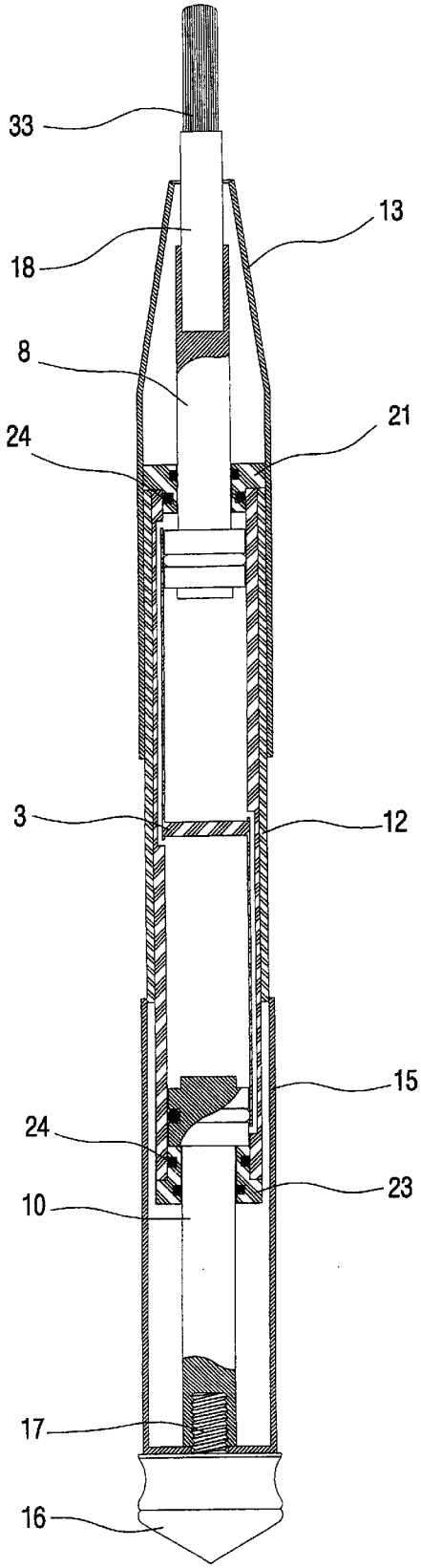
FIG. 7 is a sectional view, showing an operation of the hand-held multipurpose casing of FIG. 6.
Figure 8:
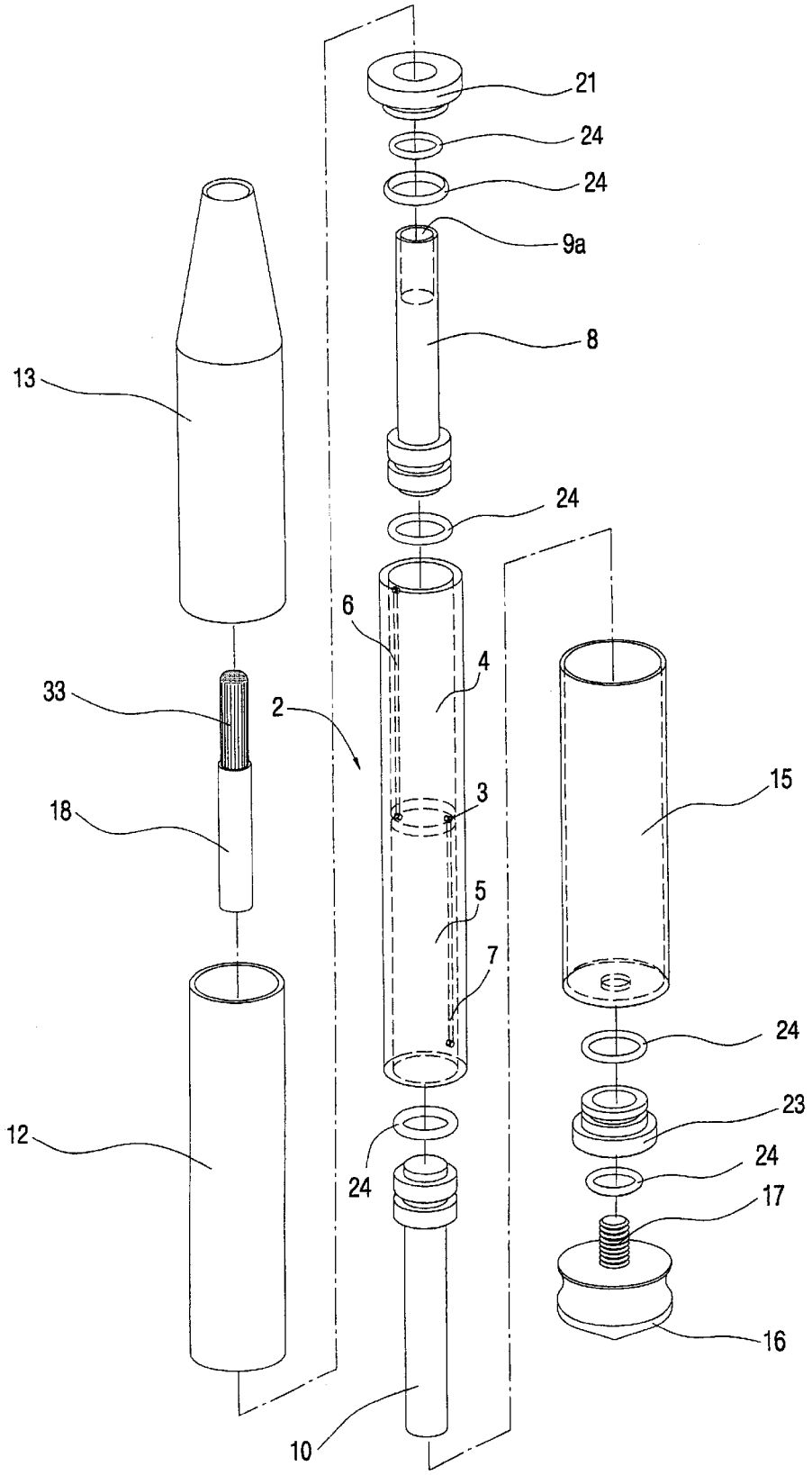
FIG. 8 is an exploded perspective view of the hand-held multipurpose casing of FIG. 6.

FIG. 6 is a sectional view of a hand-held multipurpose casing, having a cylinder-type actuating unit and used as a makeup brush casing, in accordance with the second embodiment of the present invention. FIG. 7 is a sectional view, showing an operation of the hand-held multipurpose casing of FIG. 6. FIG. 8 is an exploded perspective view of the hand-held multipurpose casing of FIG. 6.

As shown in FIGS. 6 to 8, the multipurpose casing of this second embodiment comprises the front, middle and rear barrels 13, 12 and 15, with a cap 16 in the same manner as that described for the primary embodiment, but houses a cylinder-type actuating unit in place of the screw-type unit of the primary embodiment. In the multipurpose casing of this embodiment, the cylinder-type actuating unit, used for projecting and retracting the makeup brush 33 relative to the casing, comprises a cylinder 2, with both a thrust rod 8 and a cap rod 10 oppositely and axially set within the cylinder 2.

The above cylinder 2 has a hollow cylindrical shape, with a partition. wall 3 formed within the cylinder 2 at a middle position. The partition wall 3 thus divides the interior of the cylinder 2 into first and second chambers 4 and 5. The first chamber 4 of the cylinder 2 receives the thrust rod 8 integrated with the makeup brush 33, while the second chamber 5 receives the cap rod 10 integrated with the cap 16.

Each of the thrust rod 8 and the cap rod 10 is provided with a sealing ring 24, such as a rubber or silicon ring, at its inside end, thus acting as a piston that is movable within an associated chamber of the cylinder 2 while accomplishing a desired sealing effect within the cylinder 2 during its opposite directional movement within the cylinder 2.

A first air path 6 is axially formed along the sidewall of the cylinder 2 at a position corresponding to the first chamber 4 in such a way that the path 6 extends from the first chamber 4 to the second chamber 5. On the other hand, a second air path 7 is axially formed along the sidewall of the cylinder 2 at a position corresponding to the second chamber 5 in such a way that the path 7 extends from the second chamber 5 to the first chamber 4.

The first and second air paths 6 and 7 are used for allowing a flow of compressed air between the first and second chambers 4 and 5 during a movement of the two rods 8 and 10 within the cylinder 2.

In a detailed description, when the rear barrel 15 integrated with the cap 16 is pulled backward from the middle barrel 12 after completely setting the two rods 8 and 10 within the chambers 4 and 5 of the cylinder 2 as shown in FIG. 6, the cap rod 10 is moved backward within the second chamber 5 since the rod 10 is integrated with the cap 16. Air within the second chamber 5 is thus compressed and is introduced into the first chamber 4 through the second air path 7, thus projecting the thrust rod 8 from the first chamber 4 of the cylinder 2. This finally projects the makeup brush 33, mounted to the brush holder 18 of the thrust rod 8, from the front opening of the front barrel 13 to the outside.

Two slots are axially formed on the external surface of the cylinder 2 at diametrically opposite positions. The above slots are used for movably receiving two protective cover members 30 and 32 which will be described in detail later herein.

Two packing plugs 21 and 23 are closely fitted into the opposite ends of the cylinder 2, with a plurality of sealing rings 24 being positioned at the junctions between the rods 8 and 10, the packing plugs 21 and 23 and the cylinder 2. The packing plugs 21 and 23 thus accomplish a desired sealing effect of the chambers 4 and 5 while allowing an axial movement of the two rods 8 and 10 relative to the chambers 4 and 5.

In the present invention, the sealing rings 24 are preferably selected from O-rings made of rubber or silicon.

An opening 9*a* is axially formed at the front end of the thrust rod 8 and firmly receives the rear end of the brush holder 18 therein. The rear end of the thrust rod 8, provided with a sealing ring 24, is inserted into the first chamber 4 of the cylinder 2.

On the other hand, an internally threaded opening 11 is axially formed at the rear end of the cap rod 10 and engages with the bolt 17 of the cap 16, and so the cap rod 10 is integrated with the cap 16. The front end of the cap rod 10, provided with a sealing ring 24, is inserted into the second chamber 5 of the cylinder 2.

In the cylinder-type actuating unit of the second embodiment, the thrust rod 8, the cap rod 10 and the cylinder 2 are assembled as follows:

The thrust rod 8 and the cap rod 10 are received into the first and second chambers 4 and 5 of the cylinder 2. When the cap rod 10 is moved in a direction, the thrust rod 8 is moved in another direction opposite to the moving direction of the cap rod 10 by the compressed air introduced from the second chamber 5 into the first chamber 4. That is, when the rear barrel 15, integrated with the cap 16, is moved backward on the middle barrel 12 from the front barrel 13, the cap rod 10 is moved in the same direction. The cap rod 10 compresses air within the second chamber 5 and allows the compressed air to be introduced from the second chamber 5 into the first chamber 4 so as to project the thrust rod 8 from the first chamber 4 of the cylinder 2. This finally projects the makeup brush 33 from the front opening of the casing.

As described above, the makeup brush 33 is projected from the front opening of the front barrel in response to a backward movement of the cap rod 10 from the second chamber 5 of the cylinder 2.

In the hand-held multipurpose casing of the second embodiment, the middle barrel 12 is fitted over the cylinder 2. Since the middle barrel 12 is made of an elastic material, the barrel 12 is closely fitted over the cylinder 2 due to its elasticity, thus preventing an undesired leakage of compressed air from the first and second air paths 6 and 7 of the cylinder 2.

The rear end portion of the front barrel 13 is fixedly fitted over the front end portion of the middle barrel 12, while the front end portion of the rear barrel 15 is movably fitted over the rear end portion of the middle barrel 12.

The cap 16 is integrated with the rear end of the rear barrel 15. In such a case, the bolt 17 of the cap 16 is tightened to the internally threaded opening 11 of the cap rod 10.

In the multipurpose casing of this embodiment, the makeup brush 33, such as a loose powder brush, a fan brush, a lip brush, a mascara brush, an eyeliner brush, or a brow brush, is held on the front tip of the brush holder 18 firmly inserted into the opening 9*a* of the thrust rod 8. Of course, it should be understood that a painting brush in place of the makeup brush may be mounted to the brush holder 18. In addition, a writing point, such as the point of a ballpoint pen, a pencil point, or a felt tip point, in place of the makeup brush may be mounted to the holder 18.

In the multipurpose casing of the second embodiment, the cylinder 2 is fixed to the middle barrel 12, which is integrated with the front barrel 13. In addition, the cap 16 is integrated with the cap rod 10 that is movably received within the second chamber 5 of the cylinder 2. This cap 16 is also integrated with the rear barrel 15. The rear barrel 15 is movably fitted over the rear end portion of the middle barrel 12. Therefore, when it is desired to project the makeup brush 33 from the front opening of the casing, the rear barrel 15 or the cap 16 is moved backward from the front barrel 13, thus moving the cap rod 10 in the same direction. This finally allows the thrust rod 8 to be moved forward within the casing so as to project the brush 33 from the front opening of the casing.

When it is desired to project the brush 33 of the brush holder 18 from the front opening of the casing so as to use the brush 33, the rear barrel 15 integrated with the cap 16 is moved backward on the middle barrel 12 from the front barrel 13 while gripping the front and rear barrels 13 and 15 with two hands of a user. Therefore, the cap rod 10 is extended backward from the second chamber 5 of the cylinder 2 while compressing air within the second chamber 5.

The compressed air flows from the second chamber 5 into the first chamber 4 through the second air path 7, thus pushing the sealed inside end of the thrust rod 8 forward.

That is, the backward movement of the cap rod 10 within the second chamber 5 of the cylinder 10 compresses air within the second chamber 5. The compressed air is introduced from the second chamber 5 into the first chamber 4 through the second air path 7, and forces the thrust rod 8 within the first chamber 4 to be moved in a forward direction.

The brush holder 18, fixedly mounted to the front end of the thrust rod 8, is moved forward. Therefore, the makeup brush 33 of the brush holder 18 is projected from the front opening of the casing to the outside.

When the thrust rod 8 is moved forward within the first chamber 4 of the cylinder 2 to project the brush 33 from the front opening of the casing as described above, air within the first chamber 4 at a position between the sealed inside end of the thrust rod 8 and the sealed outside end of the chamber 4 is gradually compressed, and is introduced into the second chamber 5 through the first air path 6 to push the inside end of the cap rod 10. Therefore, it is possible for the cap rod 10 to be smoothly movable backward within the second chamber 5 of the cylinder 2.

On the other hand, when it is desired to retract the brush 33 into the front opening of the casing after using the brush 33, the rear barrel 15 is fully moved forward on the middle barrel 12 until the rear barrel 15 completely covers the middle barrel 12. When the rear barrel 15 is moved forward as described above, the thrust rod 8 is fully moved backward within the casing. The makeup brush 33 is thus fully retracted into the front barrel 13 of the casing, and is stored within the casing.

That is, when the cap rod 10, integrated with the rear barrel 15, is moved backward within the second chamber 5 of the cylinder 2, the sealed inside end of the cap rod 10 compresses air within the cavity between the sealed inside end of the cap rod 10 and the sealed outside end of the second chamber 5. This compressed air flows from the second chamber 5 into the first chamber 4 through the second air path 7, thus pushing the sealed inside end of the thrust rod 8 backward within the first chamber 4 of the cylinder 2.

When the thrust rod 8 is moved backward within the first chamber 4 of the cylinder 2 as described above, air within the cavity between the sealed inside end of the thrust rod 8 and the sealed outside end of the chamber 4 is gradually compressed. This compressed air is introduced into the second chamber 5 through the first air path 6 to push the inside end of the cap rod 10. It is thus possible for the cap rod 10 to be smoothly movable backward within the second chamber 5 of the cylinder 2.

Therefore, the makeup brush 33 of the brush holder 18 set within the hand-held multipurpose casing according to the second embodiment is extended from or retracted into the front opening of the casing in accordance with an opposite directional movement of the rear barrel 15 on the middle barrel 12 relative to the front barrel 13.

Figure 9:
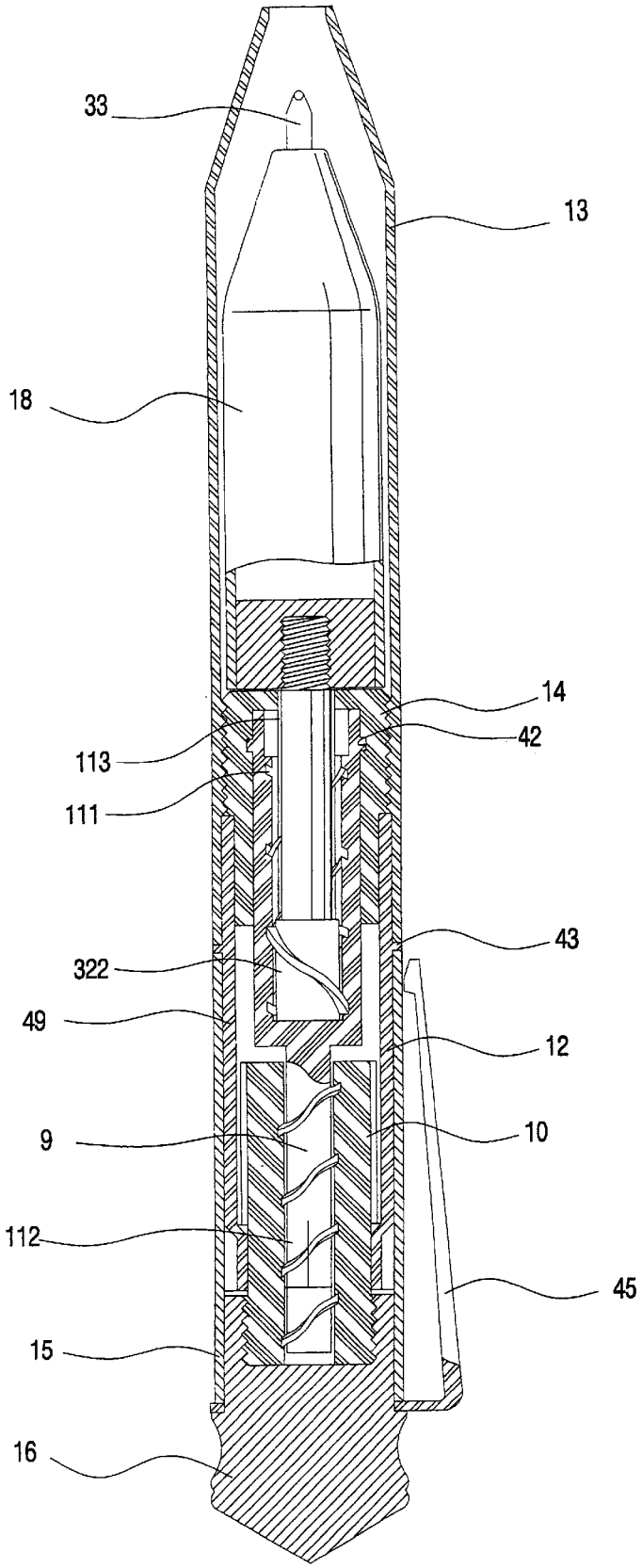
FIG. 9 is a sectional view of a hand-held multipurpose casing, having a screw-type actuating unit and used as a writing instrument casing, in accordance with the third embodiment of the present invention.
Figure 10:
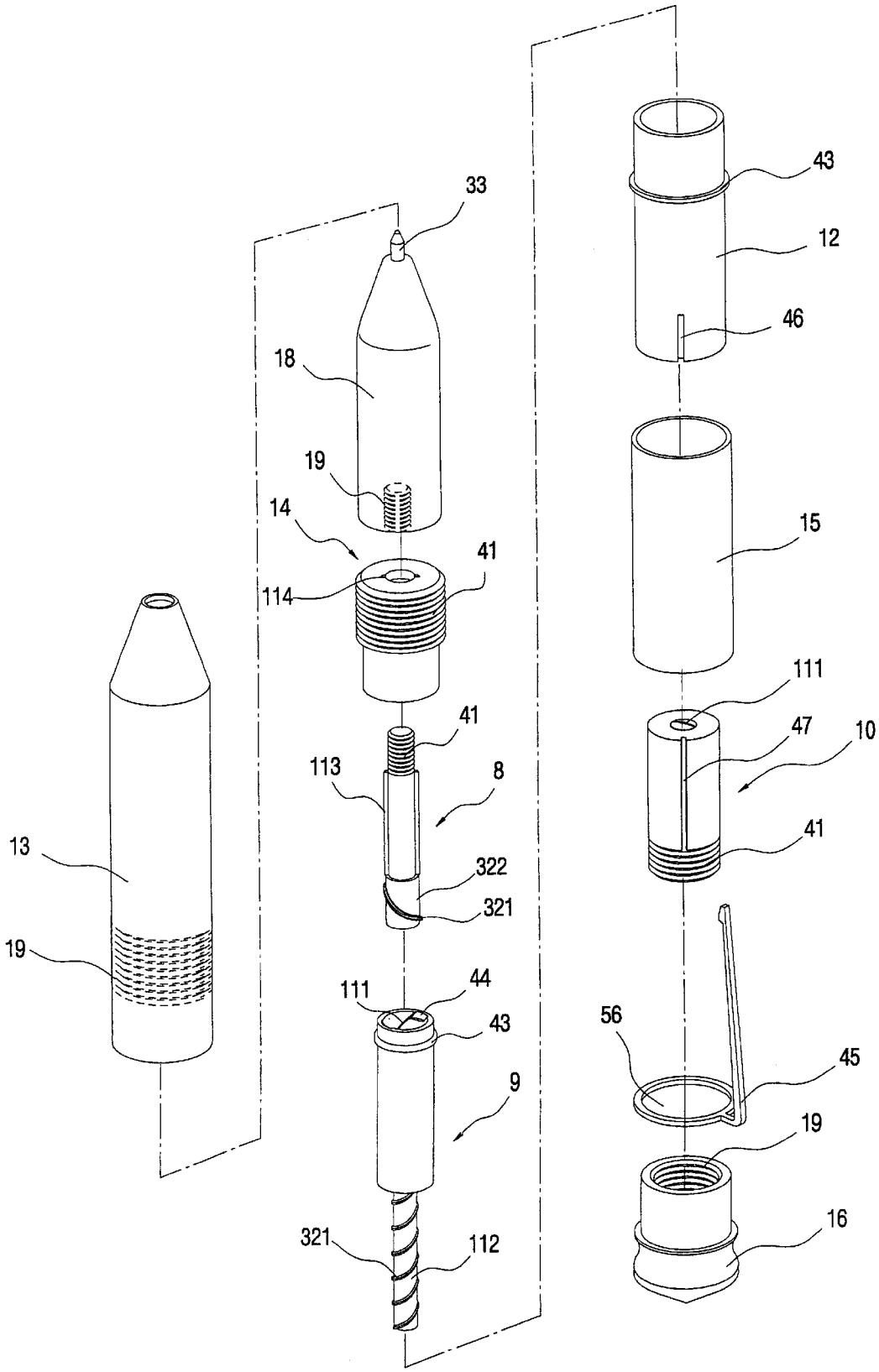
FIG. 10 is an exploded perspective view of the hand-held multipurpose casing of FIG. 9.
Figure 11:
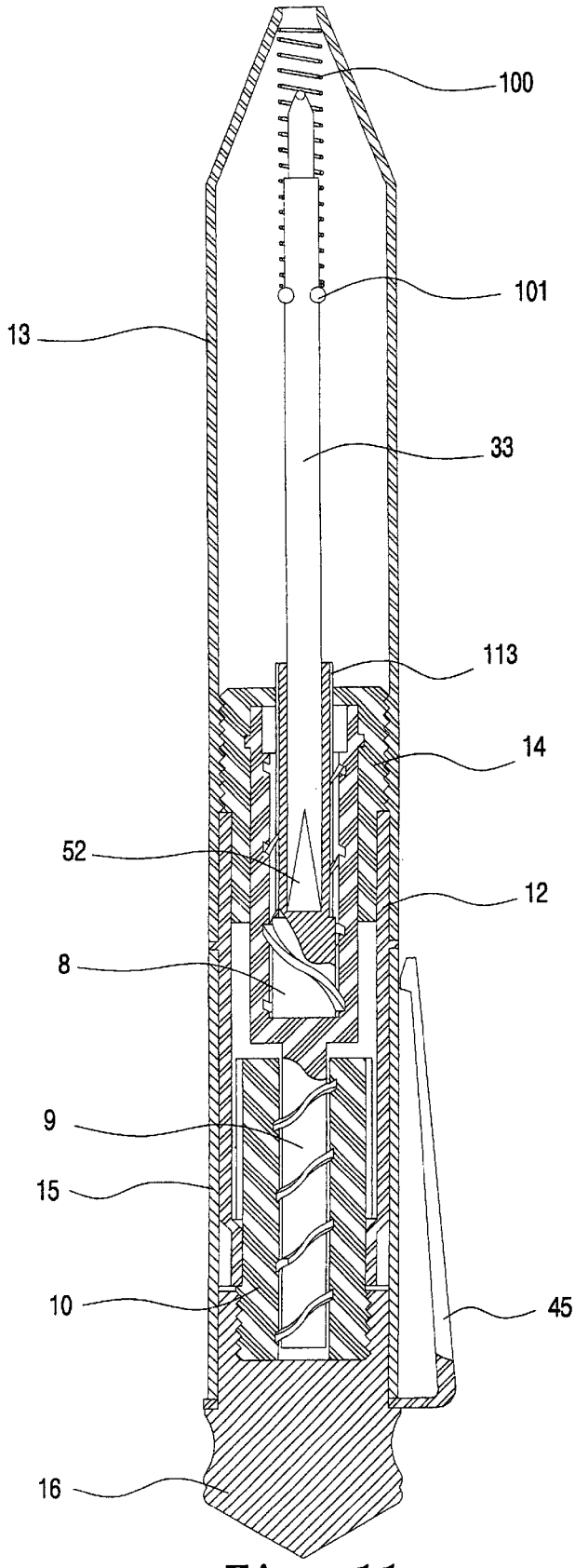
FIG. 11 is a sectional view of a hand-held multipurpose casing, having a screw-type actuating unit and used as a writing instrument casing, in accordance with the fourth embodiment of the present invention.
Figure 12:
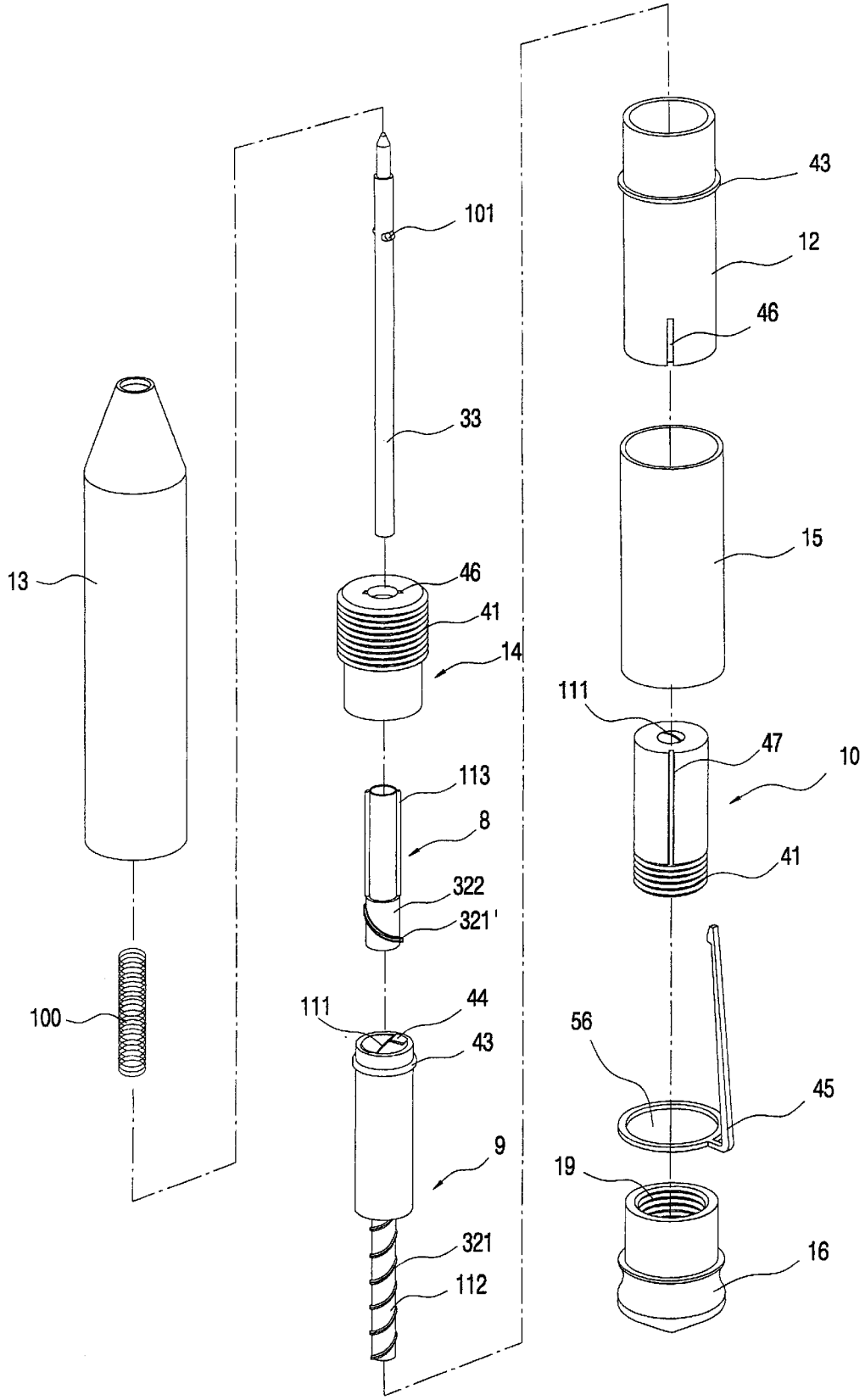
FIG. 12 is an exploded perspective view of the hand-held multipurpose casing of FIG. 11.

FIG. 9 is a sectional view of a hand-held multipurpose casing, having a screw-type actuating unit and used as a writing instrument casing, in accordance with the third embodiment of the present invention. FIG. 10 is an exploded perspective view of the hand-held multipurpose casing of FIG. 9. FIG. 11 is a sectional view of a hand-held multipurpose casing, having a screw-type actuating unit and used as a writing instrument casing, in accordance with the fourth embodiment of the present invention. FIG. 12 is an exploded perspective view of the hand-held multipurpose casing of FIG. 11.

As shown in FIGS. 9 and 10, the profile of the hand-held multipurpose casing according to the third embodiment of this invention is formed by a hollow cylindrical front barrel 13, having an internal thread 19 at its rear end with a conical front end, a hollow middle barrel 12, and a hollow rear barrel 15. A cap 16 is fixedly fitted into the rear end of the cylindrical rear barrel 15. The multipurpose casing of this invention houses a screw-type actuating unit used for projecting or retracting a writing point 33 relative to the casing. The screw-type actuating unit, housed within the multipurpose casing according to the third embodiment, comprises a point holder 18, which has a point 33 at its front end and an internally threaded hole 19' at its rear end. The actuating unit also has a packing plug 14, having an external thread 41 on its external surface. This plug 14 engages with the front barrel 13 through a screw-type engagement of its external thread 41 with the internal thread 19 of the front barrel 13. The packing plug 14 is centrally holed to have a central hole, with both an annular fitting groove 42 formed on the internal surface of the holed plug 14 and two axial guide grooves 114 formed along the internal surface of the plug 14 at diametrically opposite positions. On the other hand, a thrust rod 8, having an external thread 41' at its front end, is coupled to the point holder 18 through a screwtype engagement of its external thread 41' with the internally threaded hole 19' of the point holder 18. The above thrust rod 8 also has a cylindrical boss 322 at its rear end portion, with an external spiral thread 321 being formed on the external surface of the boss 322. Two guide rails 113 are axially formed along the external surface of the thrust rod 8 at diametrically opposite positions. The cylindrical boss 322 of the thrust rod 8 is inserted into a cup-shaped cylindrical seat of a rotatable rod 9. The cylindrical seat of the rotatable rod 9 has a fitting ring 43 on its external surface, and is inserted into the central hole of the packing plug 14, with the fitting ring 43 engaging with the fitting groove 42 of the plug 14. In the rotatable rod 9, the cylindrical seat is integrated with the front end of a longitudinal actuating part 112 having an external spiral thread 321'. The cup-shaped cylindrical seat of the rotatable rod 9 also has an internal spiral thread 111 on its internal surface, with a stop groove 44 formed at the front end of the internal spiral thread 111 of the cylindrical seat and used for preventing an undesired movement of the thrust rod 8. The longitudinal actuating part 112 of the rotatable rod 9 engages with a cylindrical cap rod 10. A guide groove 47 is axially formed along the external surface of the centrally holed cap rod 10. In addition, an external thread 41" is formed at the rear end portion of the external surface of the cap rod 10, while an internal spiral thread 111' is formed on the internal surface of the cap rod 10. On the other hand, the middle barrel 12 is fixedly fitted into the rear end of the front barrel 13 at its front end portion, and is movably fitted into the front end of the rear barrel 15 at its rear end portion. The above middle barrel 12 has a partition ring 43' on its external surface so as to separate the front and rear barrels 13 and 15 from each other. A guide projection 46 is axially formed on the internal surface of the middle barrel 12, and movably engages with the axial guide groove 47 of the cap rod 10. Due to the movable engagement of the guide projection 46 of the middle barrel 12 with the guide groove 47 of the cap rod 10, it is possible to prevent an undesired rotating action of the cap rod 10 relative to the middle barrel 12. The rear barrel 15 is movably fitted over the rear portion of the middle barrel 12 so as to be moved on the middle barrel 12 in opposite directions as desired. On the other hand, the cap 16 is fixedly fitted into the rear end of the cylindrical rear barrel 15. This cap 16 also has an internally threaded hole 19" at its front end, and is integrated with the cap rod 10 through a screw-type engagement of its internally threaded hole 19" with the external thread 41" of the cap rod 10. The multipurpose casing of this embodiment also has a clip 45, of which the ring 56 is fitted over the cap 16 while being compressed between the rear end of the rear barrel 15 and an external annular seat of the cap 16.

In the third embodiment, the point 33 may be selected from the points of a variety of pens, such as felt tip point pens.

In addition, the spiral direction of the external thread 321 of the thrust rod 8 is opposite to that of the external thread 321' of the rotatable rod 9.

The construction and operation of the above multipurpose casing will be described in detail herein below.

In order to assemble the casing, the rotatable rod 9 is assembled with the cap rod 10 by making the external spiral thread 321' of the rotatable rod 9 movably engage with the internal spiral thread 111' of the cap rod 10. In addition, the thrust rod 8 is coupled to the rotatable rod 9 by inserting the cylindrical boss 322 of the thrust rod 8 into the cup-shaped cylindrical seat of the rotatable rod 9. In such a case, the external spiral thread 321 of the cylindrical boss 322 movably engages with the internal spiral thread 111 formed on the internal surface of the cylindrical seat of the rotatable rod 9. The packing plug 14 is fitted over the front end portion of the rotatable rod 9, with the fitting groove 57 of the plug 14 engaging with the fitting ring 43 of the rotatable rod 9. In addition, the external thread 41' of the thrust rod 8 engages with the internally threaded hole 19' of the point holder 18, thus assembling the thrust rod 8 with the point holder 18.

The middle barrel 12 is fitted over the cap rod 10. In addition, the front barrel 13 is fixedly fitted over the front portion of the middle barrel 12, while the rear barrel 15 is movably fitted over the rear portion of the middle barrel 12 so as to be movable on the middle barrel 12 in opposite directions as desired. In such a case, the front barrel 13 is fixed to the packing plug 14, and so the point holder 18 linearly moves in an axial direction in response to a rotating action of the rotatable rod 9.

On the other hand, since the guide rails 113 of the thrust rod 8 movably engage with the guide grooves 114 of the packing plug 14, the thrust rod 8 is stably movable within the fixed packing plug 14 in an axial direction under the guidance of the guide grooves 114 of the plug 14. In addition, the guide projection 46 of the middle barrel 12 movably engages with the axial guide groove 47 of the cap rod 10, thus preventing an undesired rotating action of the cap rod 10 relative to the middle barrel 12.

When it is desired to project the point 33 from the front opening of the casing so as to use the writing instrument, the rear barrel 15 having the cap 16 is moved backward on the middle barrel 12 from the front barrel 13 while gripping the front and rear barrels 13 and 15 with two hands of a user. Therefore, the cap rod 10 integrated with the cap 16 is moved in the same direction.

In such a case, the rotatable rod 9, movably assembled with the cap rod 10 through a screw-type engagement, is rotated clockwise.

Due to such a clockwise rotating action of the rotatable rod 9, the thrust rod 8 is axially moved forward since the external spiral thread 321 of the thrust rod 8 movably engages with the internal spiral thread 111 of the rotatable rod 9. The point 33 is fully projected from the front opening of the casing, thus allowing the user to use the point 33 of the writing instrument.

In the hand-held multipurpose casing according to the fourth embodiment of this invention, a longitudinal ballpoint pen cartridge 33 is used in place of the point of the third embodiment as shown in FIGS. 11 and 12.

The operation and general construction of the multipurpose casing of the fourth embodiment remain the same as those of the third embodiment except for the fact that the fourth embodiment uses a ballpoint pen cartridge 33 in place of the point, and so the operation and construction of this embodiment will be described in brief herein below.

In the fourth embodiment, the longitudinal cartridge 33 is provided with two spring stoppers 101. The two spring stoppers 101 are formed on the front portion of the external surface of the cartridge 33 at diametrically opposite positions. When assembling the cartridge 33 within the casing, a compression coil spring 100 is movably fitted over the cartridge 33 at the front portion so as to be stopped by the spring stoppers 101. The spring 100 thus normally biases the cartridge 33 backward so as to allow the cartridge 33 to be normally retracted into the casing. The rear end of the cartridge 33 is inserted into the front end of the thrust rod 8.

A sharpened cartridge holder 52 is fixedly formed within the thrust rod 8, and holds the rear end of the cartridge 33 within the thrust rod 8.

Figure 13:
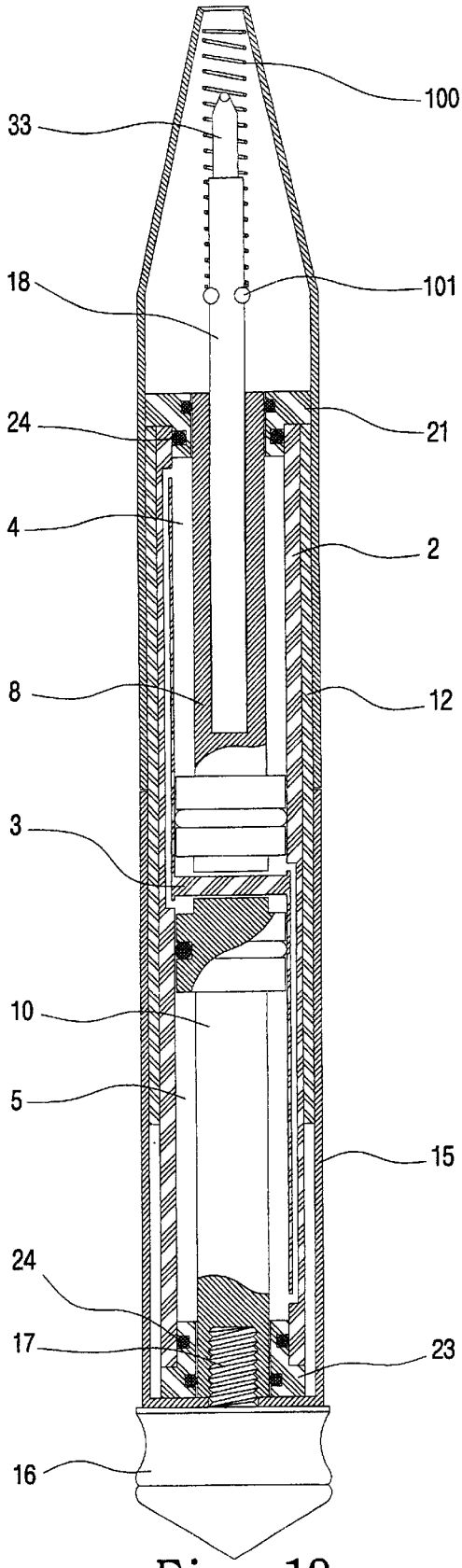
FIG. 13 is a sectional view of a hand-held multipurpose casing, having a cylinder-type actuating unit and used as a writing instrument casing, in accordance with the fifth embodiment of the present invention.
Figure 14:
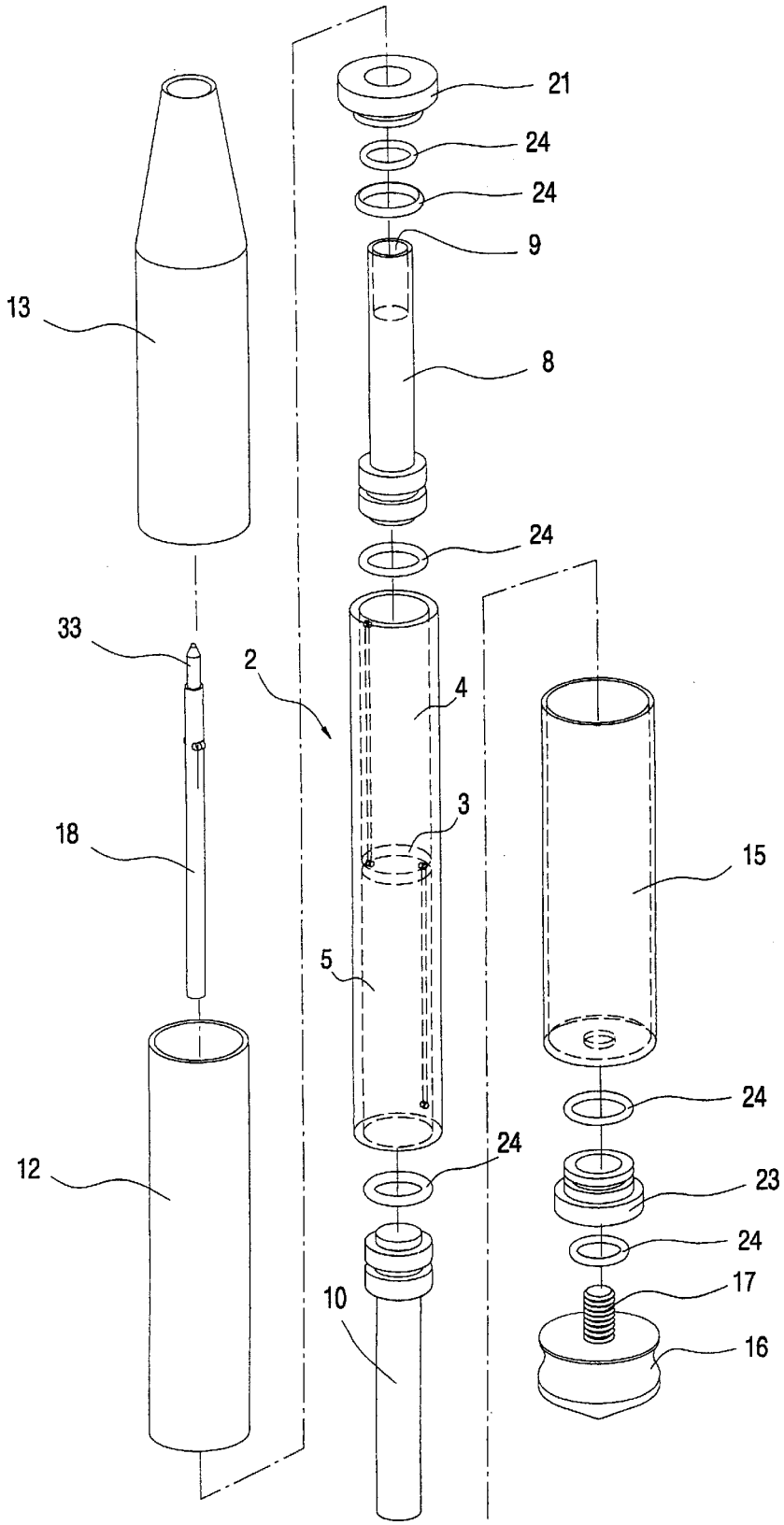
FIG. 14 is an exploded perspective view of the hand-held multipurpose casing of FIG. 13.

FIG. 13 is a sectional view of a hand-held multipurpose casing, having a cylinder-type actuating unit and used as a writing instrument casing, in accordance with the fifth embodiment of the present invention. FIG. 14 is an exploded perspective view of the hand-held multipurpose casing of FIG. 13.

The operation and general construction of the multipurpose casing of the fifth embodiment remain the same as those of the second embodiment except for the fact that the fifth embodiment uses a point of a ballpoint pen cartridge in place of the makeup brush of the second embodiment, and so the operation and construction of this embodiment will be described in brief herein below.

In the hand-held multipurpose casing according to the fifth embodiment of this invention, a point 33 is fixedly fitted into the front end of the point holder 18, thus forming a ballpoint pen cartridge that is held on the front end of the thrust rod 8. In such a case, the cartridge has two spring stoppers 101 at the front portion of the point holder 18, and holds a compression coil spring 100 at the stoppers 101 in the same manner as that described for the fourth embodiment. In order to firmly hold the rear end of the point holder 18 of the cartridge, the front end of the thrust rod 8 has an axial hole.

Figure 15:
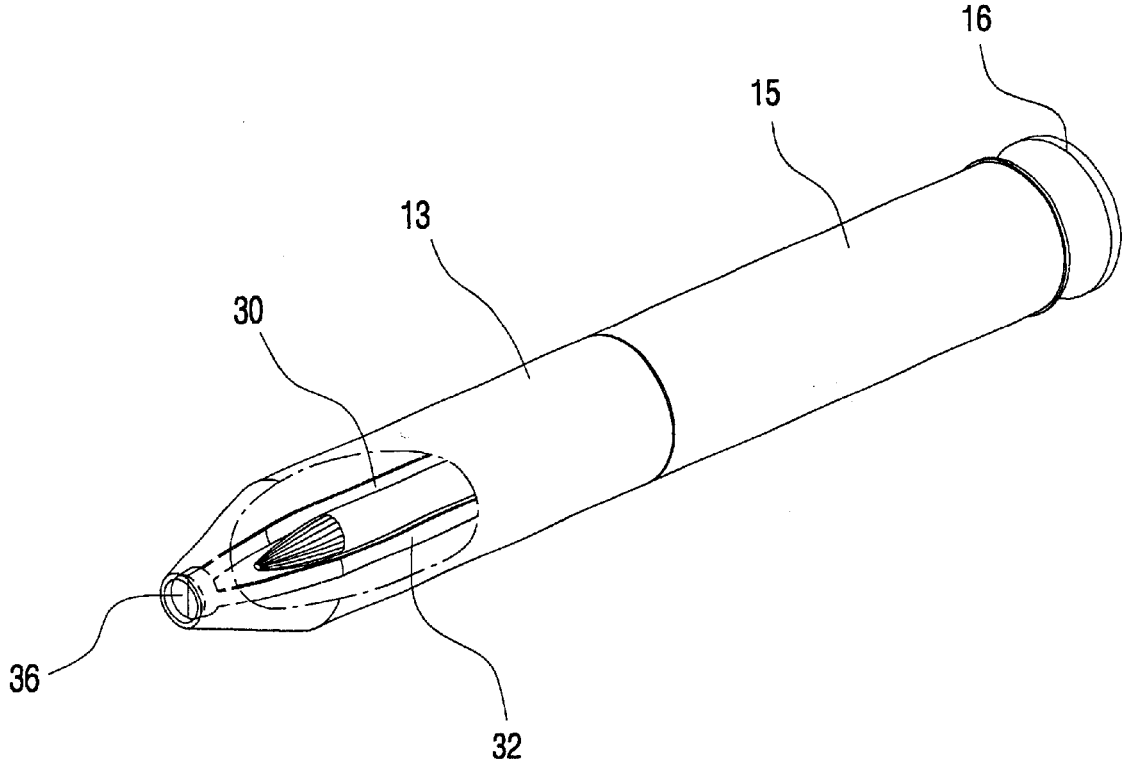
FIG. 15 is a perspective view of a hand-held multipurpose casing, having a screw-type actuating unit and used as a makeup brush casing, in accordance with the sixth embodiment of the present invention, particularly showing an automatically operated brush cover set within the casing.
Figure 16:
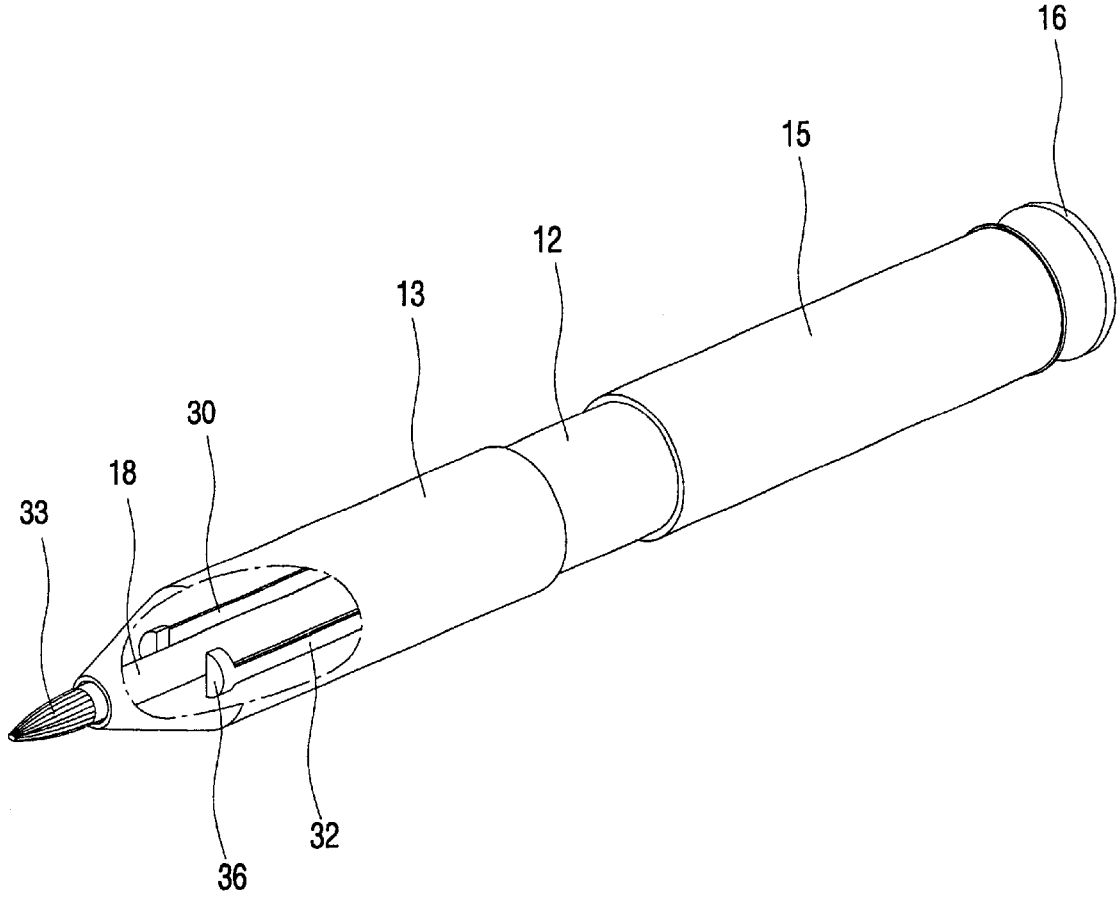
FIG. 16 is a perspective view showing an operation of the hand-held multipurpose casing of FIG. 15.

FIG. 15 is a perspective view of a hand-held multipurpose casing, having a screw-type actuating unit and used as a makeup brush casing, in accordance with the sixth embodiment of the present invention, particularly showing an automatically operated brush cover set within the casing. FIG. 16 is a perspective view showing an operation of the hand-held multipurpose casing of FIG. 15.

As shown in FIGS. 15 and 16, the hand-held multipurpose casing according to the sixth embodiment of the present invention comprises a hollow front barrel 13, having a cylindrical shape with a conical front end, a hollow middle barrel 12 having a cylindrical shape, and a hollow rear barrel 15. The front end portion of the middle barrel 15 is fixedly fitted into the rear end portion of the front barrel 13, while the rear end portion of the middle barrel 12 is movably fitted into the front end portion of the rear barrel 15. A cap 16 is fixedly fitted into the rear end of the cylindrical rear barrel 15. The multipurpose casing of this embodiment houses a screw-type actuating unit used for projecting or retracting a makeup brush 33 relative to the casing.

The rear barrel 15 is movably fitted over the rear end portion of the middle barrel 12 as described above, and so the rear barrel 15 is axially slidable on the middle barrel 12 in opposite directions as desired.

When the rear barrel 15 is moved backward on the middle barrel 12 from the front barrel 13, the makeup brush 33, held on the front tip of the brush holder 18, is projected from the front opening of the front barrel 13.

In the sixth embodiment, the casing has an automatically operated brush cover, comprising two cover members 30 and 32 extending along the brush holder 18 at diametrically opposite positions within the casing. The above brush cover is used for preventing an undesired introduction of foreign substances, such as dust, into the interior of the casing.

Figure 17:
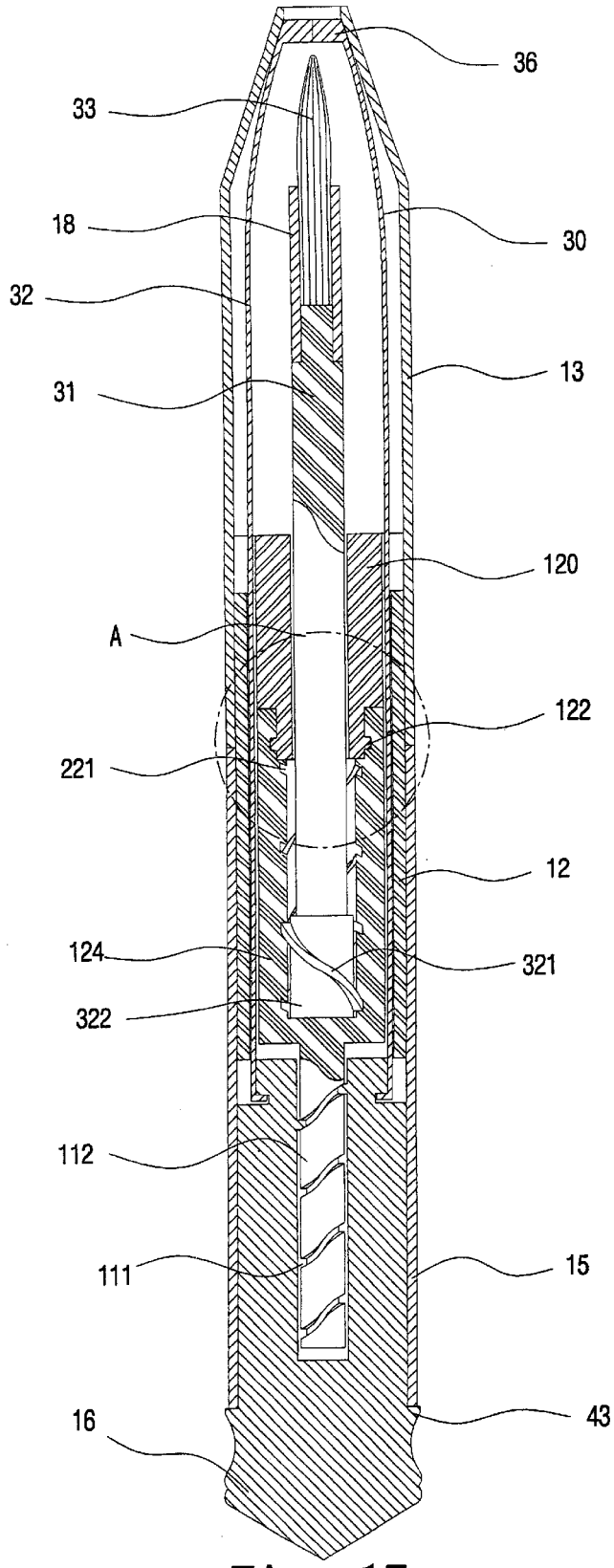
FIG. 17 is sectional view of the hand-held multipurpose casing of FIG. 15.
Figure 19:
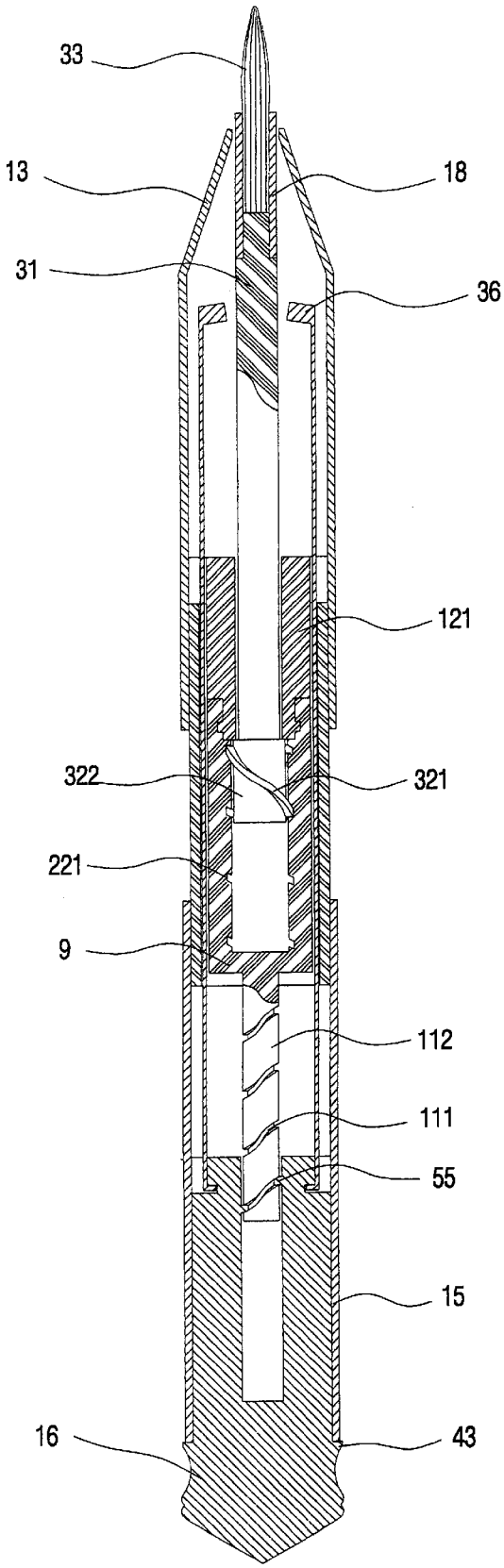
FIG. 19 is a sectional view showing the operation of the hand-held multipurpose casing of FIG. 15.
Figure 20:
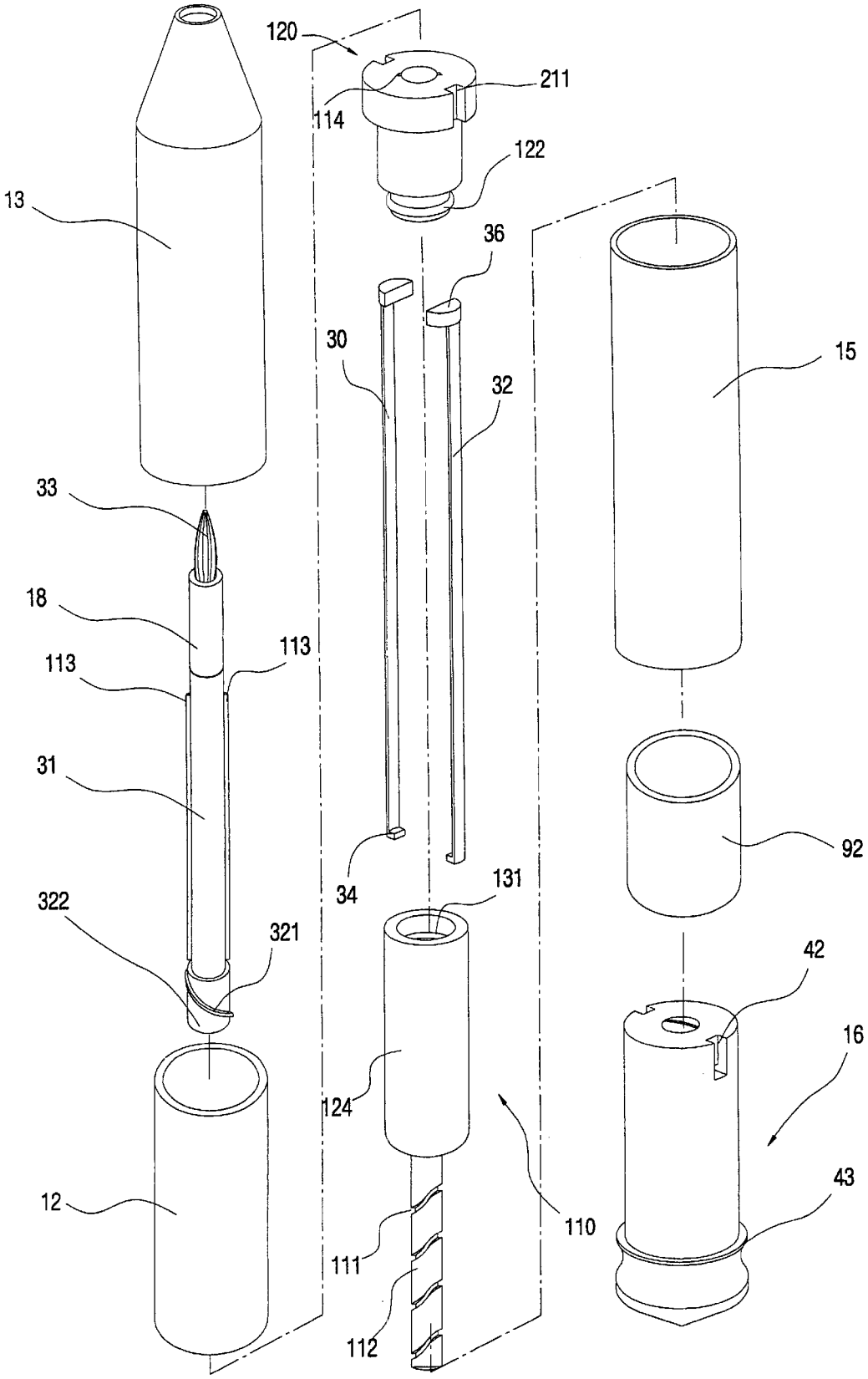
FIG. 20 is an exploded perspective view of the hand-held multipurpose casing of FIG. 15.

FIG. 17 is sectional view of the hand-held multipurpose casing of FIG. 15. FIG. 18 is a sectional view of the portion "A" of FIG. 17. FIG. 19 is a sectional view showing the operation of the hand-held multipurpose casing of FIG. 15. FIG. 20 is an exploded perspective view of the hand-held multipurpose casing of FIG. 15.

As shown in FIGS. 17 to 20, the screw-type actuating unit, housed within the multipurpose casing according to the sixth embodiment, comprises a rotatable rod 110, a packing plug 120, a thrust rod 31, two cover members 30 and 32, and a brush holder 18. In the above actuating unit, the rotatable rod 110 consists of a cup-shaped cylindrical seat 124 integrated with the front end of a longitudinal actuating part 112 having an external spiral thread 111. On the other hand, the cup-shaped cylindrical seat 124 has an internal spiral thread 221 on its internal surface, with an annular fitting groove 131 formed at the front portion of said internal surface. The packing plug 120 is a centrally and axially holed member, with two guide slots 211 being axially formed on the external surface of the plug 120 at diametrically opposite positions. A fitting ring 122 is formed on the external surface of the packing plug 120 at a rear portion. This fitting ring 122 engages with the fitting groove 131 of the rotatable rod 110, thus accomplishing a desired engagement of the packing plug 120 with the rotatable rod 110. Two guide grooves 114 are axially formed on the internal surface of the holed plug 120 at diametrically opposite positions. On the other hand, the thrust rod 31 has a cylindrical boss 322 at its rear end portion, with an external spiral thread 321 being formed on the external surface of the boss 322. The above thrust rod 31 also has two axial guide rails 113 on its external surface at diametrically opposite positions so as to movably engage with the guide grooves 114 of the packing plug 120. The thrust rod 31 is inserted into the cylindrical seat 124 of the rotatable rod 110 and is axially movable in accordance with a rotating action of the rotatable rod 110 due to the movable engagement of its external thread 321 with the internal thread 221 of the rotatable rod 110. The brush holder 18 is mounted to the front end of the thrust rod 31 and holds the makeup brush 33 at its front tip. The cap 16 has a central hole closed at its rear end, with two guide projections 55 being formed on the internal surface of the cap 16 at diametrically opposite positions. The two guide projections 55 of the cap 16 movably engage with the external thread 111 formed on the longitudinal actuating part 112 of the rotatable rod 110. The cap 16 also has the two holding slots 42 at diametrically opposite positions on its external surface, and holds the two cover members 30 and 32 at the two holding slots 42. The above cap 16 also has an annular support seat 43 at the rear portion of its external surface. The two cover members 30 and 32 have the same construction and individually comprise a longitudinal guide part, with both a semicircular cover part 36 formed at the front end of the guide part and a bend projection 34 formed at the rear end of the guide part. When the makeup brush 33 is fully retracted into the front barrel 13, the cover parts 36 of the two cover members 30 and 32 are automatically closed, thus closing the interior of the casing and preventing an undesired introduction of foreign substances into the casing. However, when the thrust rod 31 axially moves forward to project the makeup brush 33 from the front opening of the front barrel 13, the cover parts 36 of the two cover members 30 and 32 are automatically opened to allow the thrust rod 31 to pass through the gap between the two cover parts 36. The two cover members 30 and 32 are mounted to the two holding slots 42 of the cap 16 at their bent projections 34, and so the cover members 30 and 32 are prevented from an undesired rotating action within the casing. In such a case, the longitudinal guide parts of the two cover members 30 and 32 axially extend forward along each side of the thrust rod 31 while passing through the two guide slots 211 of the packing plug 120. On the other hand, the hollow front barrel 13 has a cylindrical shape with a conical front end, and covers the front and middle portions of each of the two cover members 30 and 31. The hollow middle barrel 12, having a cylindrical shape, is firmly fitted into the rear end of the front barrel 13 and houses both the packing plug 120 and the front and middle portion of the rotatable rod 110 therein. In such a case, the internal surface of the middle barrel 12 comes into close contact with the external surfaces of the two cover members 30 and 32 at diametrically opposite positions. The hollow rear barrel 15 is movably fitted over the middle and rear portion of the middle barrel 12 at its front portion, and is firmly fitted over the cap 16 at its rear portion, with the rear end of the rear barrel 15 being firmly seated on the annular support seat 43 of the cap 16. Due to the firm engagement of the rear barrel 15 with the cap 16, the rear barrel 15 is movable along with the cap 16.

The guide projections 55, formed on the internal surface of the cap 16, movably engage with the external thread 111 formed on the longitudinal actuating part 112 of the rotatable rod 110. In addition, the spiral direction of the external thread 321 of the thrust rod 31 is opposite to that of the external thread 111 of the rotatable rod 110. Due to such a movable engagement of the projections 55 of the cap 16 with the external thread 111 of the rotatable rod 110, the rotatable rod 110 is rotated when the rear barrel 15 with the cap 16 is axially moved relative to the middle barrel 12. Such a rotating action of the rotatable rod 110 creates an axial movement of the thrust rod 31 within the casing due to a movable engagement of the internal spiral thread 221 of the rotatable rod 110 with the external spiral thread 321 of the thrust rod 31, thus finally allowing the makeup brush 33 of the brush holder 18 to be projected from or retracted into the front hole of the front barrel 13.

The fitting ring 122, formed on the external surface of the packing plug 120 at the rear portion, engages with the fitting groove 131 of the rotatable rod 110, thus holding the axial position of the rotatable rod 110 within the casing. Therefore, the axial movement of the rear barrel 15 relative to the middle barrel 12 is completely converted into a desired rotating action of the rotatable rod 110.

In the rotatable rod 110 of this embodiment, an annular fitting groove 131 is formed at the front portion of the internal surface of the cup-shaped cylindrical seat 124. On the other hand, the packing plug 120 varies in its diameter in such a way that the diameter of the rear portion of the plug 120 having the fitting ring 122 is smaller than that of the front portion of the plug 120. Therefore, it is possible to desirably reduce the frictional force between the fitting ring 122 of the plug 120 and the fitting groove 131 of the rotatable rod 110 during an axial movement of the thrust rod 31 within the packing pump 120.

The cap 16 has a U-shaped cross-section when cutting the cap 16 in an axial direction. In the cap 16, the two guide projections 55 are formed on the internal surface at diametrically opposite positions, and movably engage with the external spiral thread 111 formed on the longitudinal actuating part 112 of the rotatable rod 110. In addition, when the rear barrel 15 is integrated with the cap 16, the rear end of barrel 15 is firmly seated on the annular support seat 43 of the cap 16. The cap 16 is movable along with the rear barrel 15.

The two cover members 30 and 32, having the same construction, are made of an elastic material capable of allowing the members 30 and 32 to be elastically deformed as desired. That is, when the rear barrel 15, integrated with the cap 16, is moved backward on the middle barrel 12 so as to axially move the thrust rod 31 forward and to project the makeup brush 33 from the front opening of the front barrel 13, the two cover members 30 and 32 automatically and elastically open their cover parts 36 to allow the thrust rod 31 to pass through the gap between the two cover parts 36. On the other hand, when the rear barrel 15 is moved forward on the middle barrel 12 so as to axially move the thrust rod 31 backward and to fully retract the makeup brush 33 into the front barrel 13, the cover parts 36 of the two cover members 30 and 32 move toward the conical front end of the front barrel 13 and are automatically and elastically closed, thus closing the interior of the casing and preventing an undesired introduction of foreign substances into the casing. In such a case, the closed cover parts 36 of the two cover members 30 and 32 also protect the fully retracted makeup brush 33 from damage. Due to the two cover members 30 and 32, it is not necessary for the casing of this embodiment to have a conventional separate protective cap, and so the casing of this embodiment saves a user from the inconvenience caused by losing the separate protective cap.

The longitudinal guide parts of the two cover members 30 and 32 axially extend forward along each side of the thrust rod 31 while passing through the two guide slots 211 of the packing plug 120. In addition, the two cover members 30 and 32 are mounted to the two holding slots 42 of the cap 16 at their bent projections 34, and so the cover members 30 and 32 are prevented from an undesired rotating action within the casing. Of course, it should be understood that each of the bent projections 34 may be bent once or more as desired if the projections 34 are firmly held to the holding slots 42 of the cap 16 without being undesirably removed from the slots 42.

On the other hand, the two holding slots 42 are formed on the front end portion of the external surface of the cap 16 at diametrically opposite positions, thus firmly holding the bent projections 34 of the two cover members 30 and 32. Therefore, the packing plug 120 prevents an undesired rotating action of the two cover members 30 and 32 even though a user carelessly attempts to rotate the rear barrel 15 with the cover members 30 and 32 during an operation of the casing. The casing of this embodiment thus only allows the user to project or retract the makeup brush 33 from or into the front opening of the front barrel 13.

In this embodiment, the cap 16 may be preferably made of metal. However, it should be understood that the cap 16 may be also preferably made of plastic, rubber or silicon in addition to metal. Such a plastic, rubber or silicon cap 16 is light and allows a user to feel a soft surface while using the casing.

The front barrel 13 has a hollow cylindrical shape with a conical front end and houses the cover members 30 and 32 therein. This front barrel 13 fixedly receives the front end portion of the middle barrel 12.

The middle barrel 12, having a hollow cylindrical shape, is firmly fitted into the rear end of the front barrel 13, and comes into close contact with the external surfaces of the two cover members 30 and 32 at its internal surface. Therefore, the inner diameter of the middle barrel 12 is not smaller than a diameter formed by the two cover members 30 and 32.

The outer diameter of the rear portion of the middle barrel 12 is sufficiently smaller than the inner diameter of the rear barrel 15 as to allow the rear barrel 15 to smoothly move relative to the middle barrel 12 during an axial movement of the rear barrel 15. In such a case, the front portion of the rear barrel 15, fitted over the rear portion of the middle barrel 12, is not fixed to the middle barrel 12, but is smoothly movable relative to the middle barrel 12 even though it comes into close contact with the external surface of the middle barrel 12.

When the makeup brush 33 is fully projected from the front opening of the casing, the external surface of the middle barrel 12 is exposed to the atmosphere. However, the external surface of the middle barrel 12 is completely covered by both the front barrel 13 and the rear barrel 15 when fully retracting the makeup brush 33 into the casing.

A cylindrical slider 92 is set between the middle and rear barrels 12 and 15 as shown in FIG. 18. This slider 92 comes into contact with the rear end of the front barrel 13 when the rear barrel 15 is fully moved forward on the middle barrel 12 so as to completely cover the middle barrel 12.

Due to the above slider 92 set between the middle and rear barrels 12 and 15, the external surface of the middle barrel 12 is protected from frictional damage, such as scratching, during an axial movement of the rear barrel 15 on the middle barrel 12.

The cylindrical slider 92 is also preferably chromed, thus being effectively protected from frictional damage during an axial movement of the rear barrel 15 on the middle barrel 12.

In the multipurpose casing of this invention, the makeup brush 33, such as a loose powder brush, a fan brush, a lip brush, a mascara brush, an eyeliner brush, or a brow brush, is held on the front tip of the brush holder 18 mounted to the front end of the thrust rod 31. The thrust rod 31 has the cylindrical boss 322 at its rear end portion, with the external spiral thread 321 being formed on the external surface of the boss 322. When the above thrust rod 31 is coupled to the cylindrical seat 124 of the rotatable rod 110, the external thread 321 of the thrust rod 31 movably engages with the internal thread 221 of the rotatable rod 110.

When it is desired to project the brush 33 from the front opening of the casing so as to use the brush 33, the rear barrel 15 having the cap 16 is moved backward on the middle barrel 12 from the front barrel 13 as shown in FIG. 19 while gripping the front and rear barrels 13 and 15 with two hands of a user. Therefore, the rotatable rod 110, movably engaging with the cap 16 through a screw-type engagement, is rotated by the backward movement of the rear barrel 15. Due to such a rotating action of the rotatable rod 110, the thrust rod 31 is axially moved forward since the external spiral thread 321, formed at the cylindrical boss 322 of the thrust rod 31, movably engages with the internal spiral thread 221 formed at the cylindrical seat 124 of the rotatable rod 110. Therefore, the makeup brush 33 is fully projected from the front opening of the casing, thus allowing the user to use the brush 33.

On the other hand, when it is desired to retract the brush 33 into the front opening of the casing after using the brush 33, the rear barrel 15 is fully moved forward on the middle barrel 12 until the rear barrel 15 completely covers the middle barrel 12. In such a case, the front and rear barrels 13 and 15 are gripped with two hands of the user. When the rear barrel 15 is moved forward as described above, the thrust rod 31 is moved backward within the casing, and so the makeup brush 33 is fully retracted into the front barrel 13 of the casing, thus being stored within the casing.

Of course, it is also possible to press the cap 16 against a support surface, such as the top surface of a desk, to fully retract the brush 33 into the casing. In such a case, the retraction of the makeup brush 33 into the casing can be accomplished by using one hand.

When the rear barrel 15 is moved backward on the middle barrel 12 to project the brush 33 from the casing, the cap 16 is moved along with the rear barrel 15 in the same direction since the cap 16 is integrated with the barrel 15. In such a case, the external surface of the middle barrel 12 is exposed to the atmosphere, with the length of the casing being increased to accomplish a maximum length. However, when the rear barrel 15 is moved forward on the middle barrel 12 to fully cover the middle barrel 12 and to fully retract the brush 33 into the casing, the length of the casing is reduced to accomplish a minimum length.

Figure 21:
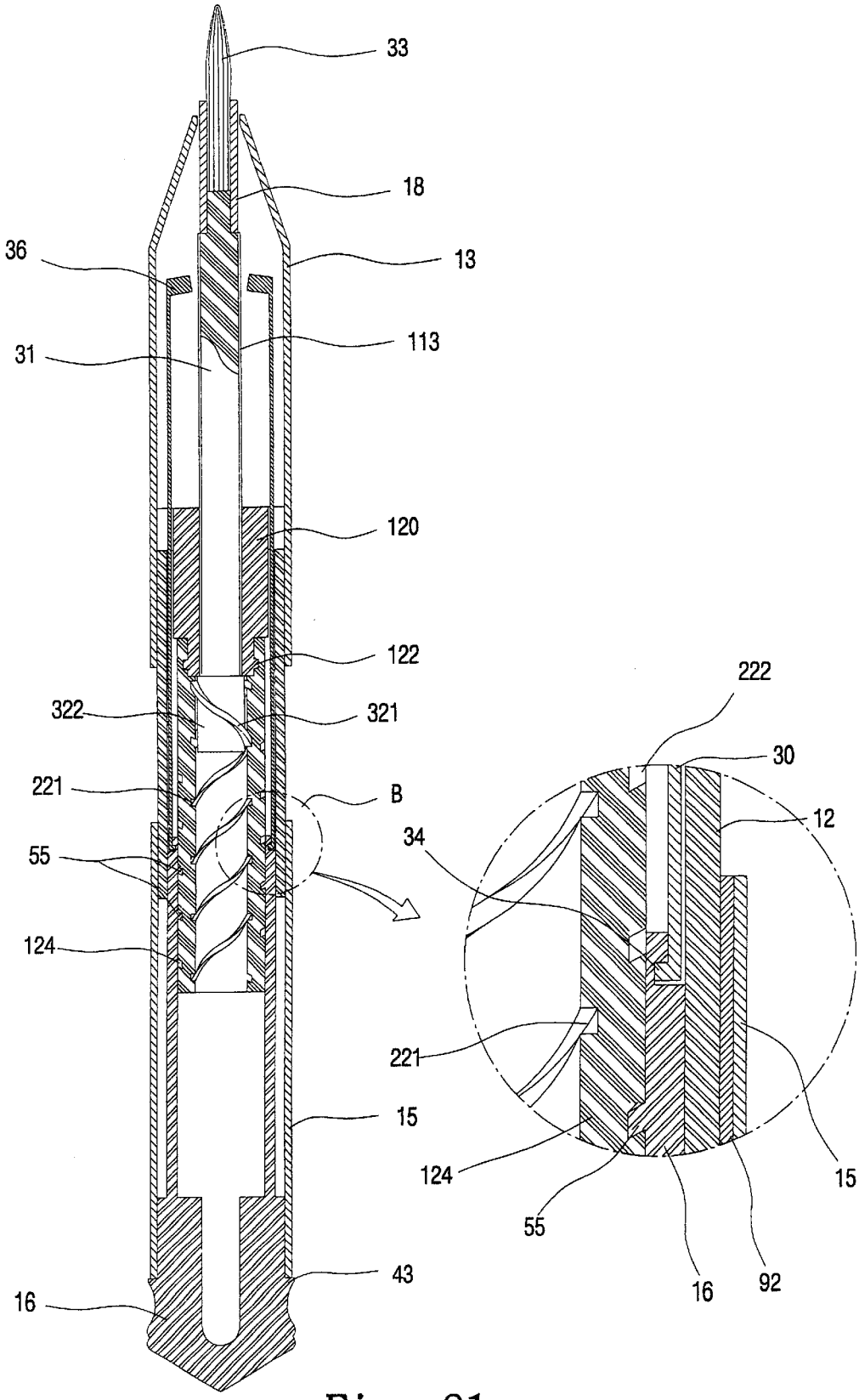
FIG. 21 is a sectional view of a hand-held multipurpose casing, having a screw-type actuating unit and used as a makeup brush casing, in accordance with the seventh embodiment of the present invention.
Figure 22:
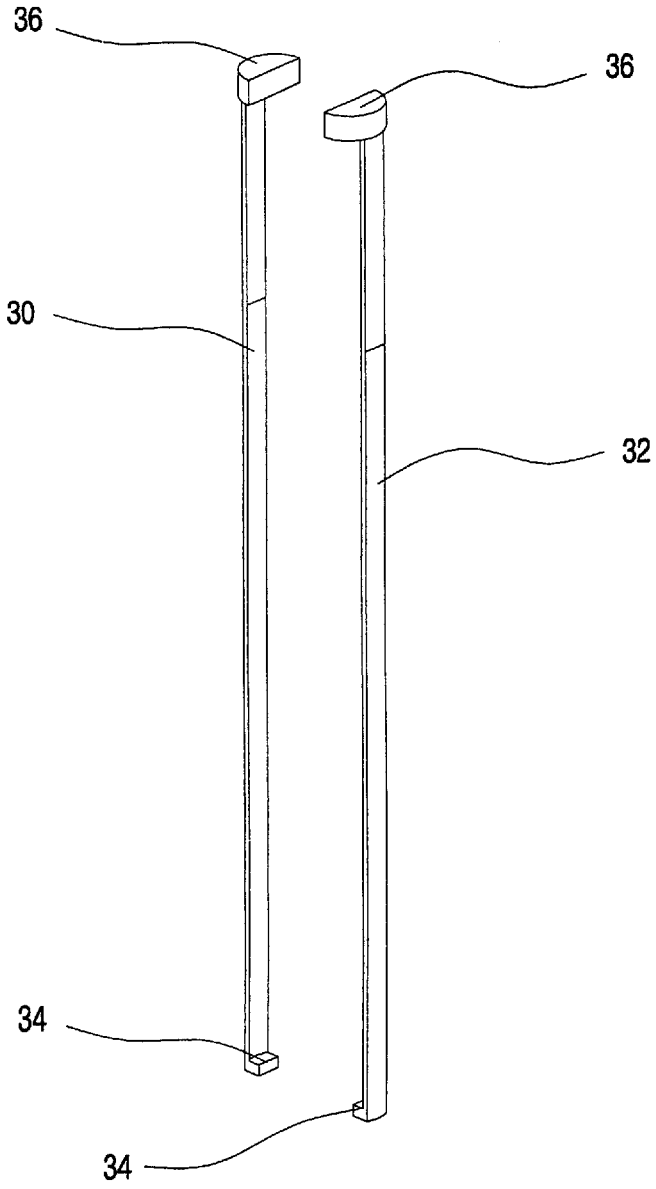
FIG. 22 is a perspective view of the brush cover according to this invention.
Figure 23:
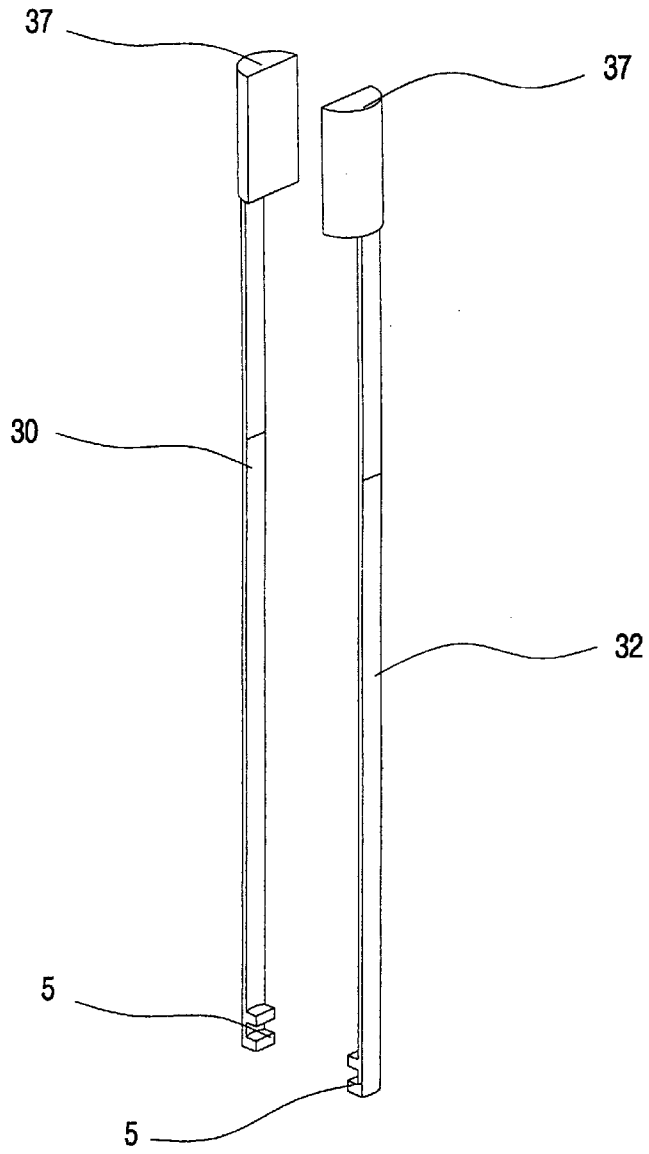
FIG. 23 is a perspective view of an automatically operated brush cover in accordance with another embodiment of this invention.

FIG. 21 is a sectional view of a hand-held multipurpose casing, having a screw-type actuating unit and used as a makeup brush casing, in accordance with the seventh embodiment of the present invention. FIG. 22 is a perspective view of the brush cover according to this invention. FIG. 23 is a perspective view of an automatically operated brush cover in accordance with another embodiment of this invention.

In the seventh embodiment of FIG. 21, the construction of the packing plug 120, the cover members 30 and 32, the three barrels 12, 13 and 15, the cylindrical slider 92, and the brush holder 18 of the casing remains the same as that described for the sixth embodiment, but the structure of both the lower part of the rotatable rod 110 and the upper part of the cap 16 is altered as follows:

That is, in this seventh embodiment, the unit for converting the axial linear movement of the cap 16 into a rotating action of the rotatable rod 110 is altered by making the rotatable rod 110 having a simple hollow cylindrical shape without the longitudinal actuating part 112 different from the embodiment of FIGS. 17 to 20. In such a case, the rotatable rod has internal and external spiral threads 221 and 222 on its internal and external surfaces, with the spiral directions of the two threads 221 and 22 being opposite to each other.

Since the rotatable rod 110 has such a simple cylindrical shape as described above, the diameter of the external spiral thread 222, formed on the external surface of the rotatable rod 110 is larger than that of the sixth embodiment. In order to allow the two projections 55 of the cap 16 to precisely engage with the external thread 221 of the rod 110, the interior surface of the cap 16 is stepped to enlarge the inner diameter of the cap 16. The two projections 55 are formed on the stepped internal surface of the cap 16 at a front portion.

FIG. 22 shows the configuration of two protective cover members 30 and 32 in accordance with an embodiment of this invention, while FIG. 23 shows the configuration of two protective cover members 30 and 32 in accordance with another embodiment. In the embodiment of FIG. 22, the two cover members 30 and 32, having the same construction, individually have a semicircular cover part 36 formed at the front end of a longitudinal guide part. The cover parts 36 of the two cover members 30 and 32 are selectively closed or opened in accordance with an axial linear movement of the cap 16. The two cover members 30 and 32 are movable in an axial direction within the casing in response to an axial movement of the cap 16 without coming into frictional contact with the internal surface of the front barrel 13. The two cover members 30 and 32 are made of an elastic material capable of allowing the longitudinal guide part of each cover member 30 or 32 to be elastically deformed during an operation of the casing. Each of the two cover members 30 and 32 has one bent projection 34 at its rear end, and is held on the cap 16 at the bent projection 34. The bent projection 34 is formed by bending the rear end of the longitudinal guide part of each cover member 30 or 32 at a right angle.

In the embodiment of FIG. 23, the general shape of each cover member 30 or 32 remains the same as that of the embodiment of FIG. 22, but the axial length of the semicircular cover part 37 is longer than that of the part 36 and two projections 5 are formed at the rear end of each cover member 30 or 32 different from the embodiment of FIG. 22. Due to the projections of FIG. 23, it is possible to more firmly hold the cover members 30 and 32 within the casing.

In the preferred embodiments of this invention, the facing surfaces of the two cover parts are flat. However, it should be understood that the two cover parts may be designed to have another shape on their facing surfaces, for example, rounded surfaces, V-grooved surfaces, or U-grooved surfaces, without affecting the functioning of this invention.

Figure 24:
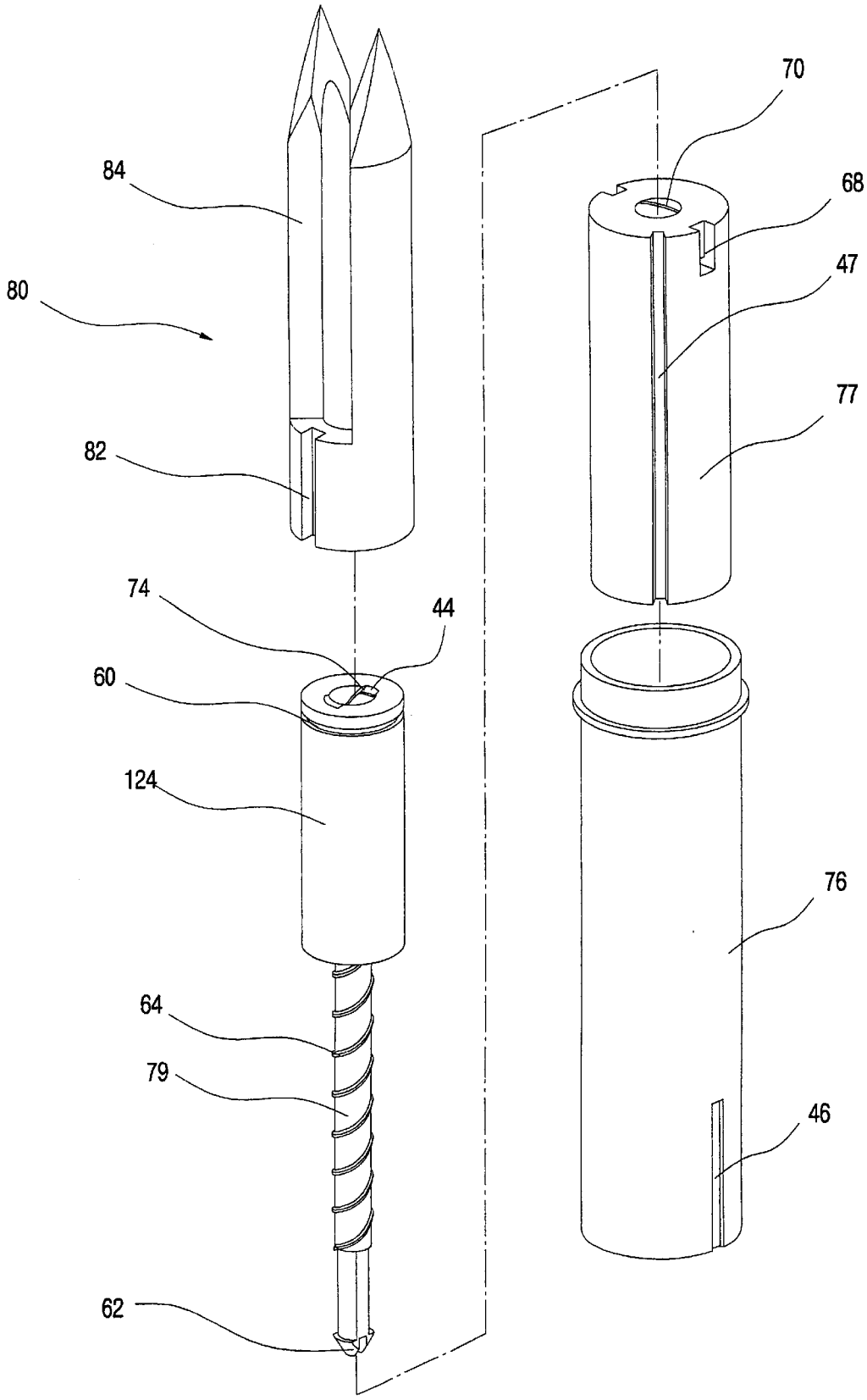
FIG. 24 is an exploded perspective view, showing the construction of a rotatable rod assembly consisting of a rotatable rod and a rod guide tube used in the screw-type hand-held multipurpose casing of the present invention.
Figure 25:
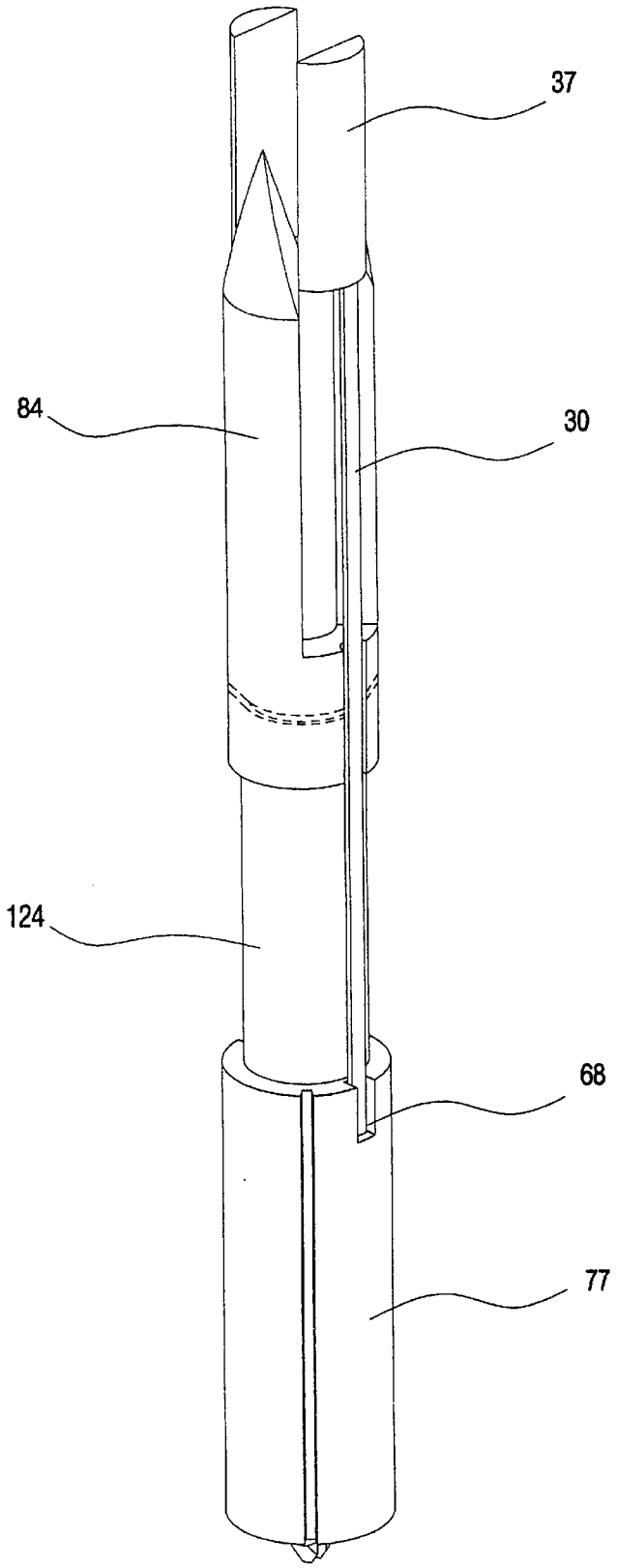
FIG. 25 is a perspective view of the rotatable rod assembly of FIG. 24.
Figure 26:
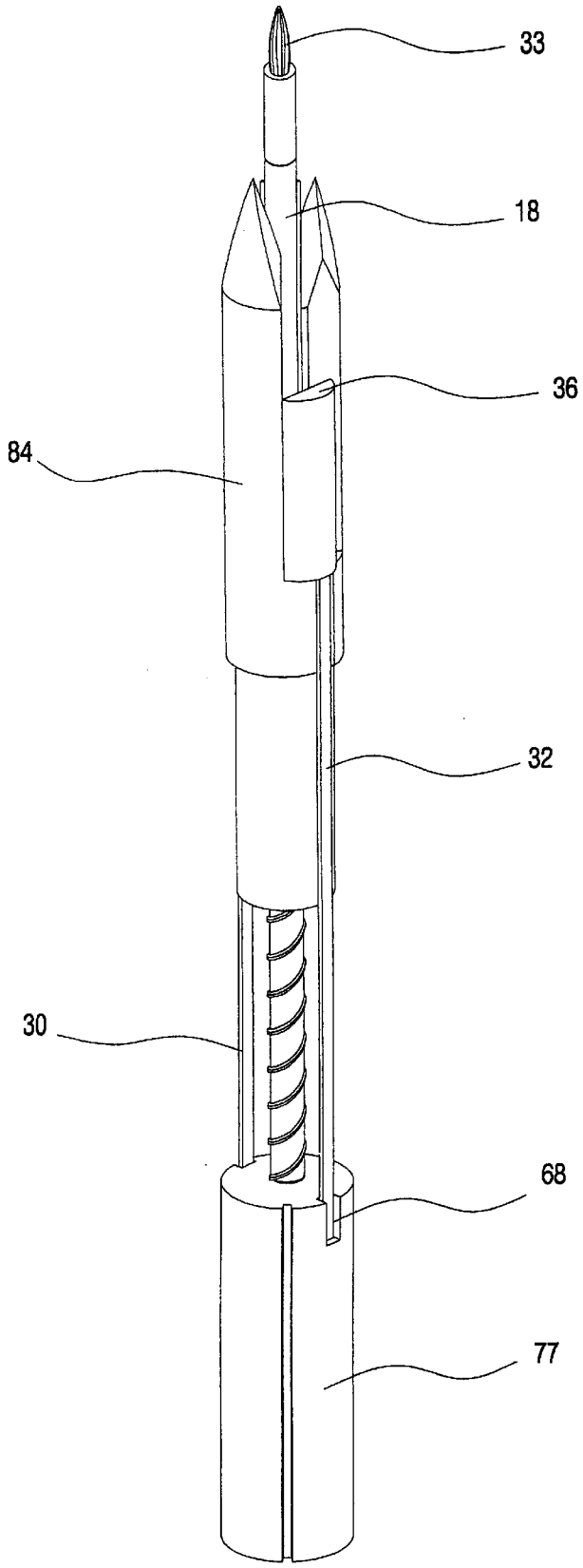
FIG. 26 is a perspective view, showing an operation of the rotatable rod assembly of FIG. 25.

FIG. 24 is an exploded perspective view, showing the construction of a rotatable rod assembly consisting of a rotatable rod and a rod guide tube used in the screw-type hand-held multipurpose casing of the present invention. FIG. 25 is a perspective view of the rotatable rod assembly of FIG. 24. FIG. 26 is a perspective view, showing an operation of the rotatable rod assembly of FIG. 25.

As shown in FIGS. 24 to 26, the cup-shaped cylindrical seat 124 of the rotatable rod 79 has a fitting ring 60 on its external surface. In the rotatable rod 79, the cylindrical seat 124 is integrated with the front end of a longitudinal actuating part having an external spiral thread 64, with a slit fixing tip 62 being provided at the rear end of the longitudinal actuating part. The cup-shaped cylindrical seat 124 of the rotatable rod 79 also has an internal spiral thread 74 on its internal surface, with a stop groove 44 formed at the front end of the internal spiral thread 74 and used for preventing an undesired movement of the makeup brush.

In the above embodiment, the spiral directions of the external and internal threads 64 and 74 of the rotatable rod 79 are opposite to each other.

The above rotatable rod 79 engages with a cylindrical cap rod 77. A guide groove 47 is axially formed along the external surface of the centrally holed cap rod 77. In addition, two slots 68 are formed on the front end of the external surface of the cap rod 77 at diametrically opposite positions. The above cap rod 77 is centrally and axially holed, with an internal spiral thread 70 being formed on the internal surface of the cap rod 77.

In order to couple the rotatable rod 79 to the cap rod 77, the longitudinal actuating part of the rotatable rod 79 is axially inserted into the central hole of the cap rod 77. In such a case, the external spiral thread 64 of the rotatable rod 79 movably engages with the internal spiral thread 70 of the cap rod 77. Therefore, the rotatable rod 79 is rotated in response to an opposite directional axial movement of the cap rod 77.

In the embodiment of FIG. 24, a guide projection 46 is axially formed on the internal surface of the middle barrel 76 at the rear end portion, and movably engages with the axial guide groove 47 of the cap rod 77. Due to the movable engagement of the guide projection 46 of the middle barrel 76 with the guide groove 47 of the cap rod 77, it is possible to prevent an undesired rotating action of the cap rod 77 relative to the middle barrel 76.

In the embodiment of FIG. 24, the movable engagement of the guide projection 46 of the middle barrel 76 with the guide groove 47 of the cap rod 77 prevents an undesired rotating action of the cap rod 77 relative to the middle barrel 76. However, it should be understood that it is also possible to form a suitable structure for preventing an undesired rotating action of the cap rod 77 relative to the middle barrel 76 by properly designing the shape of both the internal cross-section of the middle barrel 76 and the external cross-section of the cap rod 77 as, for example, angled cross-sections without affecting the functioning of this invention.

The slit fixing tip 62 of the rotatable rod 79 is coupled to the cap rod 77, and allows the rotatable rod 79 to be rotated relative to the cap rod 77.

On the other hand, the cylindrical seat 124 of the rotatable rod 79 is fitted into the rear end of a brush holder unit 80. That is, the above brush holder unit 80 has an axial hole at its rear end and receives the cylindrical seat 124 of the rotatable rod 79 in the axial hole. In such a case, an annular fitting groove is formed on the internal surface of the axial hole of the brush holder unit 80, and engages with the fitting ring 60 of the rotatable rod 79. The above brush holder unit 80 comprises two brush holders 84. The two brush holders 84 define a brush holding slot (not shown) and support a desired brush at the brush holding slot. An axial slot 82 is formed on the external surface of the lower portion of the brush holder unit 80.

The embodiment of FIGS. 24 to 26, having the stop groove 44, the guide projection 46 and the guide groove 47, may be preferably used as a hand-held casing for a pen cartridge or a painting brush in addition to a makeup brush.

Figure 27:
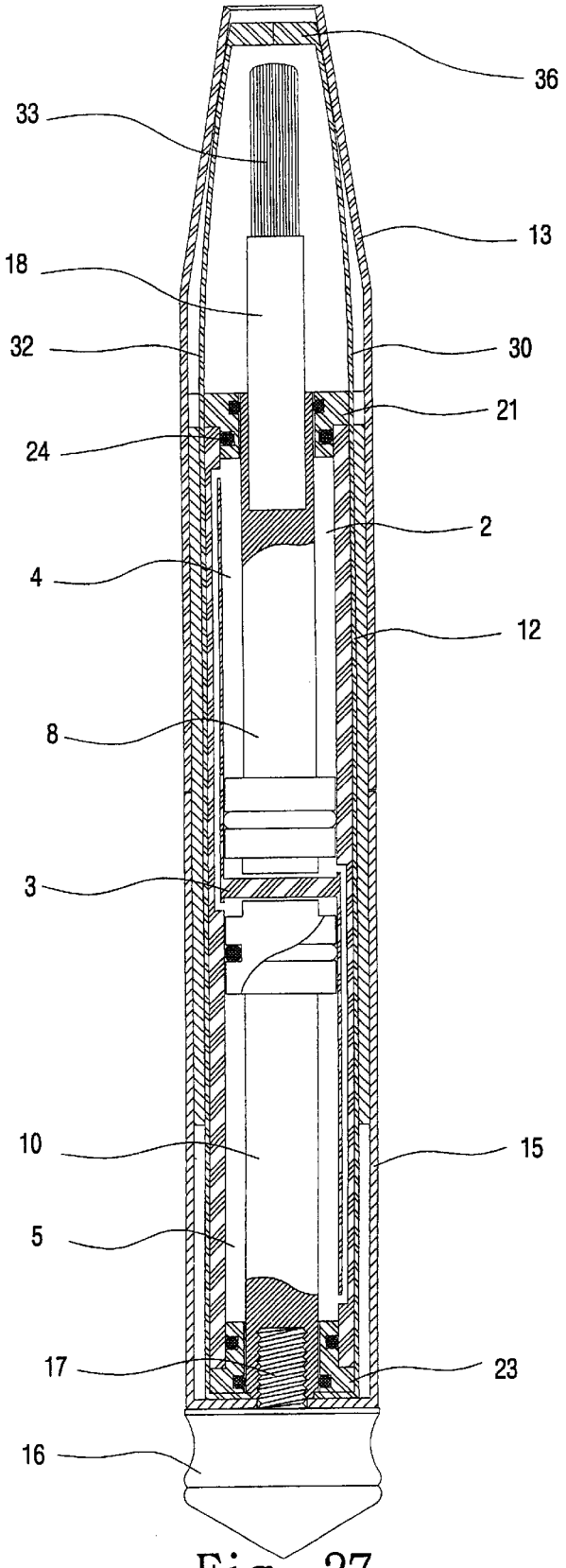
FIG. 27 is a sectional view of a hand-held multipurpose casing, having a cylinder-type actuating unit and used as a makeup brush, in accordance with the eighth embodiment of the present invention.
Figure 28:
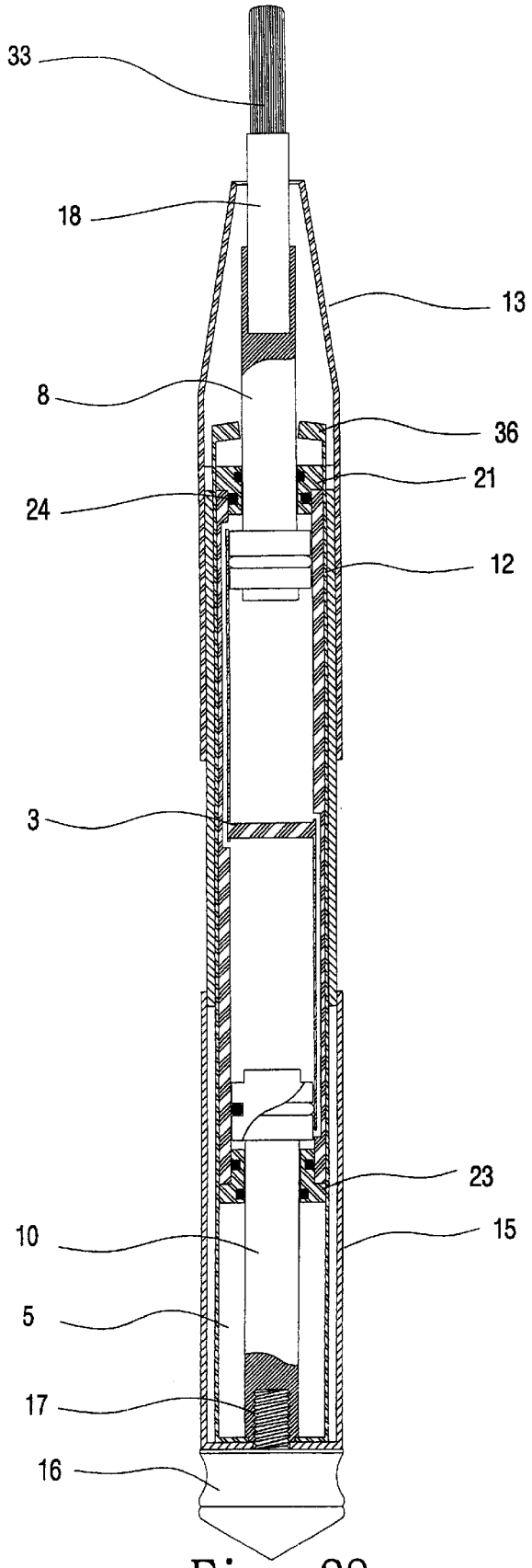
FIG. 28 is a sectional view, showing an operation of the hand-held multipurpose casing of FIG. 27.
Figure 29:
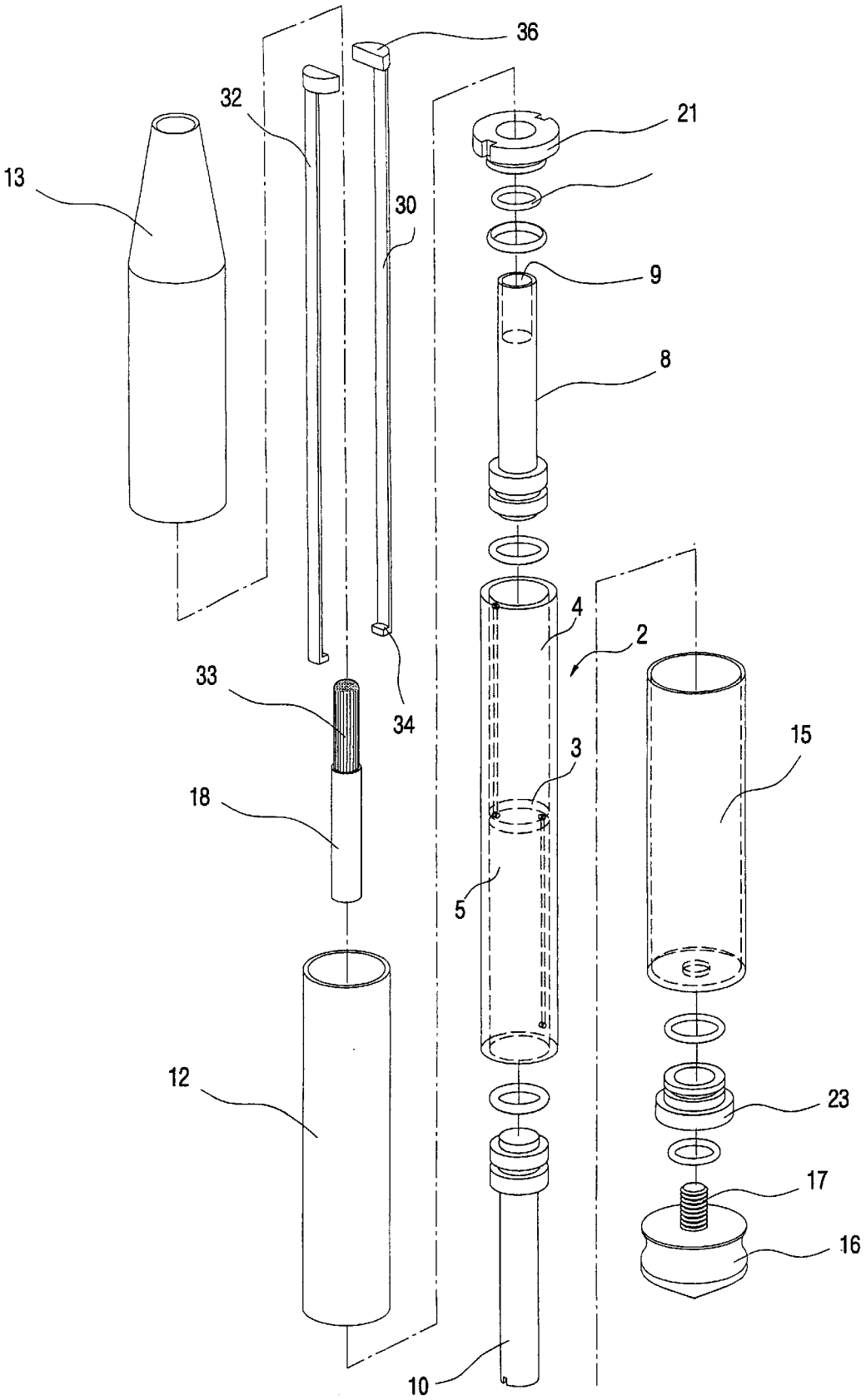
FIG. 29 is an exploded perspective view, showing the construction of the hand-held multipurpose casing of FIG. 27.

FIG. 27 is a sectional view of a hand-held multipurpose casing, having a cylinder-type actuating unit and used as a makeup brush, in accordance with the eighth embodiment of the present invention. FIG. 28 is a sectional view, showing an operation of the hand-held multipurpose casing of FIG. 27. FIG. 29 is an exploded perspective view, showing the construction of the hand-held multipurpose casing of FIG. 27.

As shown in FIGS. 27 to 29, the multipurpose casing of this eighth embodiment comprises the front, middle and rear barrels 13, 12 and 15, with a cap 16 in the same manner as that described for the second embodiment. This casing also houses a cylinder-type actuating unit used for projecting and retracting the makeup brush 33 relative to the casing. The cylinder-type actuating unit comprises a cylinder 2, with both a thrust rod 8 and a cap rod 10 oppositely and axially set within the cylinder 2.

The above cylinder 2 has a hollow cylindrical shape.

A partition wall 3 is formed within the cylinder 2 at a middle position. The partition wall 3 thus divides the interior of the cylinder 2 into first and second chambers 4 and 5. The first chamber 4 of the cylinder 2 receives the thrust rod 8, while the second chamber 5 receives the cap rod 10 integrated with the cap 16.

Each of the thrust rod 8 and the cap rod 10 is provided with a sealing ring 24, such as a rubber or silicon ring, at its inside end, thus acting as a piston that is movable within an associated chamber of the cylinder 2 while accomplishing a desired sealing effect within the cylinder 2 during its opposite directional movement within the cylinder 2.

A first air path 6 is axially formed along the sidewall of the cylinder 2 at a position corresponding to the first chamber 4 in such a way that the path 6 extends from the first chamber 4 to the second chamber 5. On the other hand, a second air path 7 is axially formed along the sidewall of the cylinder 2 at a position corresponding to the second chamber 5 in such a way that the path 7 extends from the second chamber 5 to the first chamber 4.

The first and second air paths 6 and 7 are used for allowing a flow of compressed air between the first and second chambers 4 and 5 during a movement of the two rods 8 and 10 within the cylinder 2.

In a detailed description, when the rear barrel 15 integrated with the cap 16 is pulled backward from the middle barrel 12 after completely setting the two rods 8 and 10 within the chambers 4 and 5 of the cylinder 2 as shown in FIG. 28, the cap rod 10 is moved backward within the second chamber 5 since the rod 10 is integrated with the cap 16. Air within the second chamber 5 is thus compressed and is introduced into the first chamber 4 through the second air path 7, thus projecting the thrust rod 8 from the first chamber 4 of the cylinder 2. This finally projects the makeup brush 33, mounted to the front tip of the brush holder 18 of the thrust rod 8, from the front opening of the front barrel 13 to the outside.

Two slots are axially formed on the external surface of the cylinder 2 at diametrically opposite positions. The above slots are used for movably receiving the longitudinal guide parts of two protective cover members 30 and 32. The two protective cover members 30 and 32 are held on the cap rod 10, and are axially movable within the casing along with the cap rod 10.

Two packing plugs 21 and 23 are closely fitted into the opposite ends of the cylinder 2, with a plurality of sealing rings 24 being positioned at the junctions between the rods 8 and 10, the packing plugs 21 and 23 and the cylinder 2. The packing plugs 21 and 23 thus accomplish a desired sealing effect of the chambers 4 and 5 while allowing an axial movement of the two rods 8 and 10 relative to the chambers 4 and 5.

The two cover members 30 and 32 have the same construction and individually comprise a longitudinal guide part, with both a semicircular cover part 36 formed at the front end of the guide part and a bend projection 34 formed at the rear end of the guide part. When the makeup brush 33 is fully retracted into the front barrel 13, the cover parts 36 of the two cover members 30 and 32 are automatically closed, thus closing the interior of the casing and preventing an undesired introduction of foreign substances into the casing. However, when the thrust rod 8 axially moves forward to project the makeup brush 33 from the front opening of the front barrel 13, the cover parts 36 of the two cover members 30 and 32 are automatically opened to allow the thrust rod 8 to pass through the gap between the two cover parts 36.

In the eighth embodiment, the facing surfaces of the two cover parts 36 are flat. However, it should be understood that the two cover parts 36 may be designed to have another shape on their facing surfaces, for example, rounded surfaces, V-grooved surfaces, U-grooved surfaces, or corrugated surfaces without affecting the functioning of this invention.

An opening 9*a* is axially formed at the front end of the thrust rod 8 and firmly receives the rear end of the brush holder 18 therein. Of course, the brush holder 18 holds a desired makeup brush 33. The rear end of the thrust rod 8, provided with a sealing ring 24, is inserted into the first chamber 4 of the cylinder 2.

On the other hand, an internally threaded opening 11 is axially formed at the rear end of the cap rod 10 and engages with the bolt 17 of the cap 16, and so the cap rod 10 is integrated with the cap 16. The front end of the cap rod 10, provided with a sealing ring 24, is inserted into the second chamber 5 of the cylinder 2.

In the cylinder-type actuating unit of the eighth embodiment, the thrust rod 8, the cap rod 10 and the cylinder 2 are assembled as follows:

The thrust rod 8 and the cap rod 10 are received into the first and second chambers 4 and 5 of the cylinder 2. In addition, the two protective cover members 30 and 32 are held on the holding slots of the cap rod 10 at their bent projections 34, and axially extend forward within the casing while passing along the external axial slots of the cylinder 2.

When the cap rod 10 is moved in a direction, the two cover members 30 and 32 are moved in the same direction. In addition, the thrust rod 8 is moved in another direction opposite to the moving direction of the cap rod 10 by the compressed air introduced from the second chamber 5 into the first chamber 4. That is, when the rear barrel 15, integrated with the cap 16, is moved backward on the middle barrel 12 from the front barrel 13, the cap rod 10 along with the two cover members 30 and 32 is moved in the same direction. On the other hand, the cap rod 10 compresses air within the second chamber 5 and allows the compressed air to be introduced from the second chamber 5 into the first chamber 4 so as to project the thrust rod 8 from the first chamber 4 of the cylinder 2. This finally projects the makeup brush 33 from the front opening of the casing.

When the thrust rod 8 axially moves forward within the casing as described above, the two cover members 30 and 32 move backward along with the cap rod 10. The cover parts 36 of the cover members 30 and 32 are thus automatically and elastically opened, and finally open the front end of the front barrel 13. Therefore, the two cover members 30 and 32 allow the makeup brush 33 of the brush holder 18 to be projected from the front opening of the front barrel 13 to the outside.

In the hand-held multipurpose casing of the eighth embodiment, the middle barrel 12 is fitted over the cylinder 2. Since the middle barrel 12 is made of an elastic material, the barrel 12 is closely fitted over the cylinder 2 due to its elasticity, thus preventing an undesired leakage of compressed air from the first and second air paths 6 and 7 of the cylinder 2.

The rear end portion of the front barrel 13 is fixedly fitted over the front end portion of the middle barrel 12, while the front end portion of the rear barrel 15 is movably fitted over the rear end portion of the middle barrel 12.

The cap 16 is integrated with the rear end of the rear barrel 15. In such a case, the bolt 17 of the cap 16 is tightened to the internally threaded opening 11 of the cap rod 10.

In the hand-held multipurpose casing of this embodiment, the makeup brush 33, such as a loose powder brush, a fan brush, a lip brush, a mascara brush, an eyeliner brush, or a brow brush, is held on the front tip of the brush holder 18 firmly inserted into the opening 9*a* of the thrust rod 8. Of course, it should be understood that a painting brush in place of the makeup brush may be mounted to the brush holder 18. In addition, a writing point, such as the point of a ballpoint pen, a pencil point, or a felt tip point, in place of the makeup brush may be mounted to the holder 18.

When it is desired to project the brush 33 of the brush holder 18 from the front opening of the casing so as to use the brush 33, the rear barrel 15 integrated with the cap 16 is moved backward on the middle barrel 12 from the front barrel 13 while gripping the front and rear barrels 13 and 15 with two hands of a user. Therefore, the cap rod 10 is extended backward from the second chamber 5 of the cylinder 2 while compressing air within the second chamber 5.

In such a case, the compressed air flows from the second chamber 5 into the first chamber 4 through the second air path 7, thus pushing the sealed inside end of the thrust rod 8 forward.

That is, the backward movement of the cap rod 10 within the second chamber 5 of the cylinder 10 compresses air within the second chamber 5. The compressed air is introduced from the second chamber 5 into the first chamber 4 through the second air path 7, and forces the thrust rod 8 within the first chamber 4 to be moved in a forward direction. In such a case, the two protective cover members 30 and 32 are axially moved backward along with the cap rod 10, and so the cover parts 36 of the two cover members 30 and 32 are opened to allow the brush holder 18 to pass through the gap between the opened cover parts 36. Therefore, the makeup brush 33 of the brush holder 18 is smoothly projected from the front opening of the casing to the outside.

When the thrust rod 8 is moved forward within the first chamber 4 of the cylinder 2 to project the brush 33 from the front opening of the casing as described above, air within the first chamber 4 at a position between the sealed inside end of the thrust rod 8 and the sealed outside end of the chamber 4 is gradually compressed, and is introduced into the second chamber 5 through the first air path 6 to push the inside end of the cap rod 10. Therefore, it is possible for the cap rod 10 to be smoothly movable backward within the second chamber 5 of the cylinder 2.

On the other hand, when it is desired to retract the brush 33 into the front opening of the casing after using the brush 33, the rear barrel 15 is fully moved forward on the middle barrel 12 until the rear barrel 15 completely covers the middle barrel 12. When the rear barrel 15 is moved forward as described above, the cover members 30 and 32 are moved forward within the casing, thus elastically closing the front end of the front barrel 13 by the cover parts 36. In such a case, the thrust rod 8 is fully moved backward within the first chamber 4 of the cylinder 2, and so the makeup brush 33 is fully retracted into the front barrel 13 of the casing, and is stored within the casing. That is, when the cap rod 10, integrated with the rear barrel 15, is moved backward within the second chamber 5 of the cylinder 2, the sealed inside end of the cap rod 10 compresses air within the cavity between the sealed inside end of the cap rod 10 and the sealed outside end of the second chamber 5. This compressed air flows from the second chamber 5 into the first chamber 4 through the second air path 7, thus pushing the sealed inside end of the thrust rod 8 backward within the first chamber 4 of the cylinder 2.

When the thrust rod 8 is moved backward within the first chamber 4 of the cylinder 2 as described above, air within the cavity between the sealed inside end of the thrust rod 8 and the sealed outside end of the chamber 4 is gradually compressed. This compressed air is introduced into the second chamber 5 through the first air path 6 to push the inside end of the cap rod 10. It is thus possible for the cap rod 10 to be smoothly movable backward within the second chamber 5 of the cylinder 2.

Therefore, the makeup brush 33 of the brush holder 18, set within the hand-held multipurpose casing according to the eighth embodiment, is smoothly extended from or retracted into the front opening of the casing in accordance with an opposite directional movement of the rear barrel 15 on the middle barrel 12 relative to the front barrel 13. In addition, the two protective cover members 30 and 32 of this casing prevent an undesired introduction of foreign substances, such as dust, into the interior of the casing.

Figure 30:
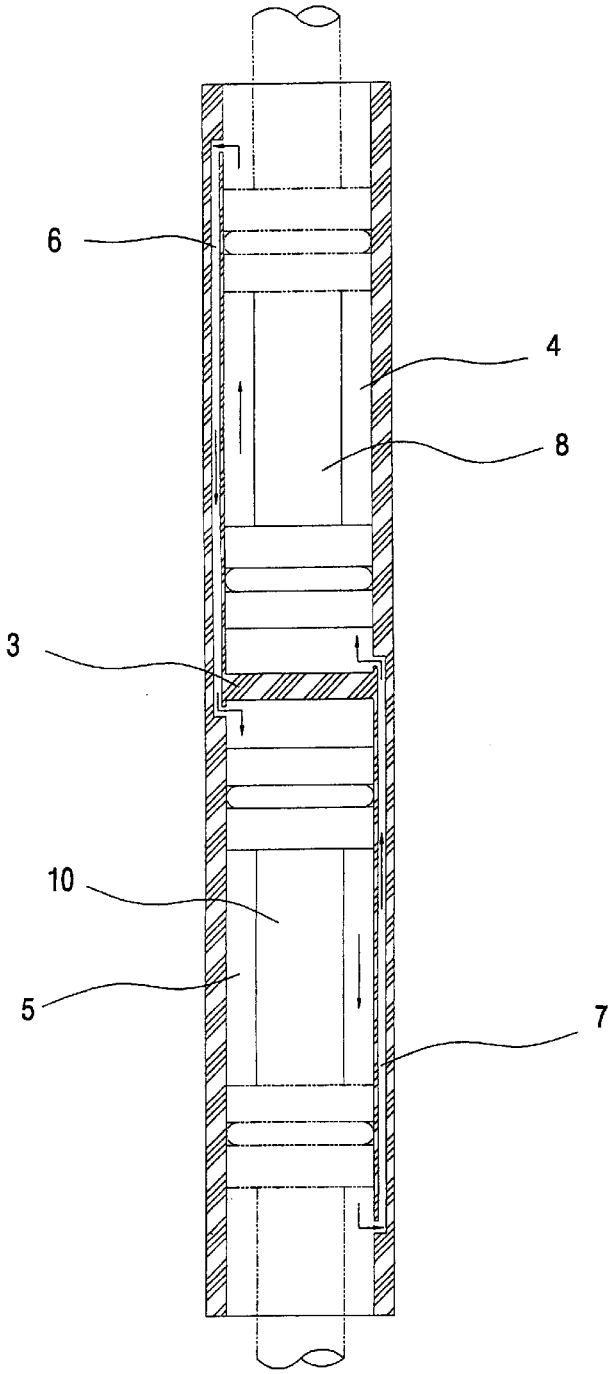
FIG. 30 is a sectional view, showing the direction of air current movements within the cylinder-type hand-held multipurpose casing of this invention in accordance with a movement of thrust and cap rods set within a cylinder.

FIG. 30 is a sectional view, showing the direction of air current movement within the cylinder-type hand-held multipurpose casing of this invention in accordance with a movement of the thrust and cap rods.

When the cap rod 10 is moved backward within the second chamber 5 of the cylinder 2 as shown by the arrow of FIG. 30, compressed air flows from the second chamber 5 into the first chamber 4 through the second air path 7, thus moving the thrust rod 8 forward within the first chamber 4 as shown by the arrow of the drawing.

A more detailed description for the air flow within the cylinder 2 may be found in the description for the embodiment of FIGS. 27 and 28.

Figure 31:
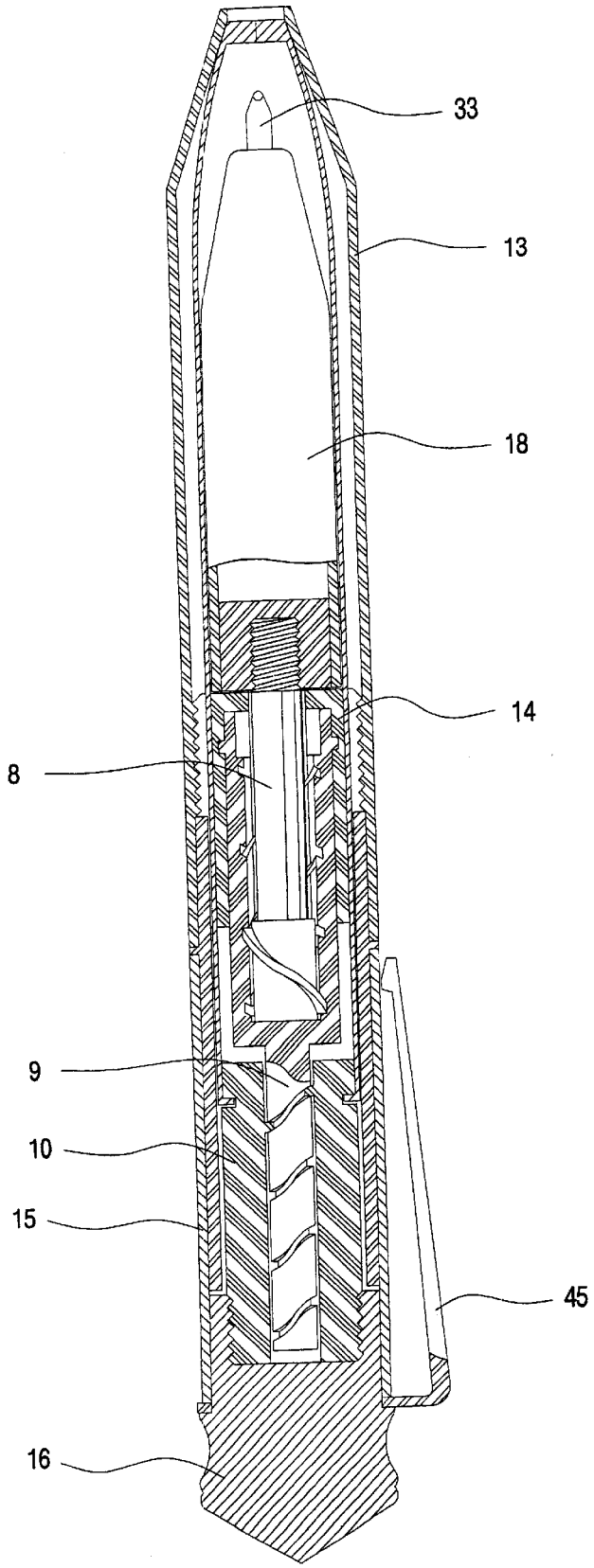
FIG. 31 is a sectional view of a hand-held multipurpose casing, having a screw-type actuating unit and used as a writing instrument casing with an automatically operated cartridge cover set within the casing, in accordance with the ninth embodiment of the present invention.
Figure 32:
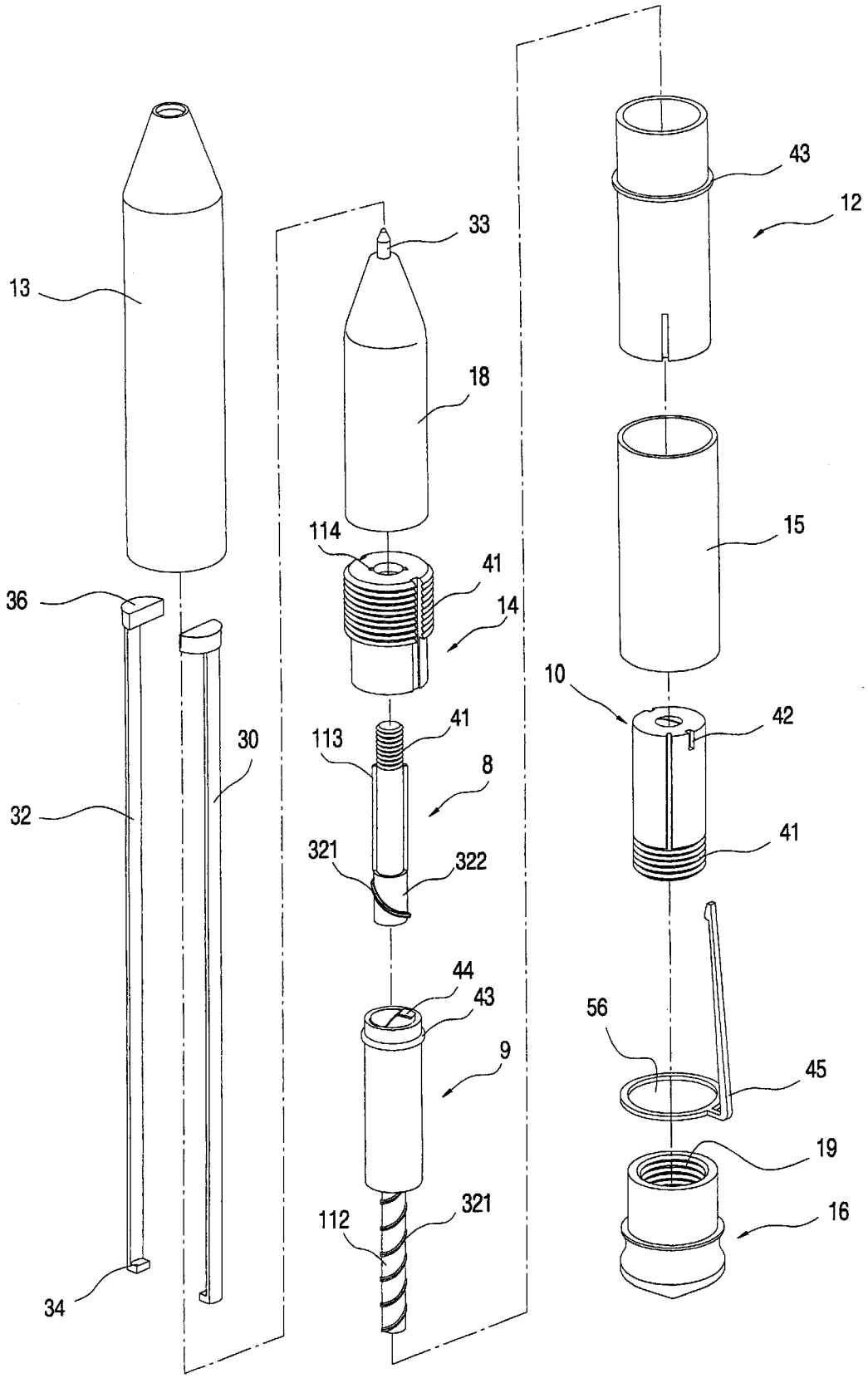
FIG. 32 is an exploded perspective view showing the construction of the hand-held multipurpose casing of FIG. 31.
Figure 33:
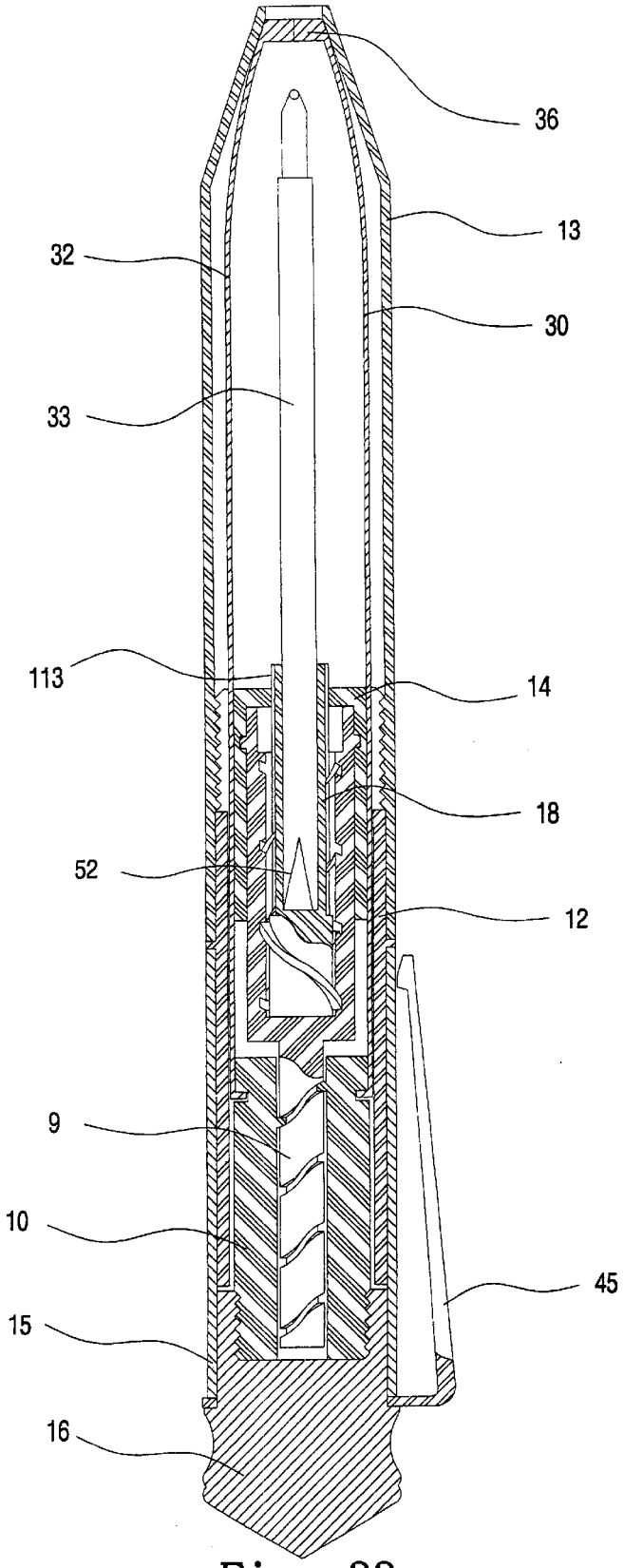
FIG. 33 is a sectional view of a hand-held multipurpose casing, having a screw-type actuating unit and used as a writing instrument casing with a ballpoint pen cartridge, in accordance with the tenth embodiment of the present invention.
Figure 34:
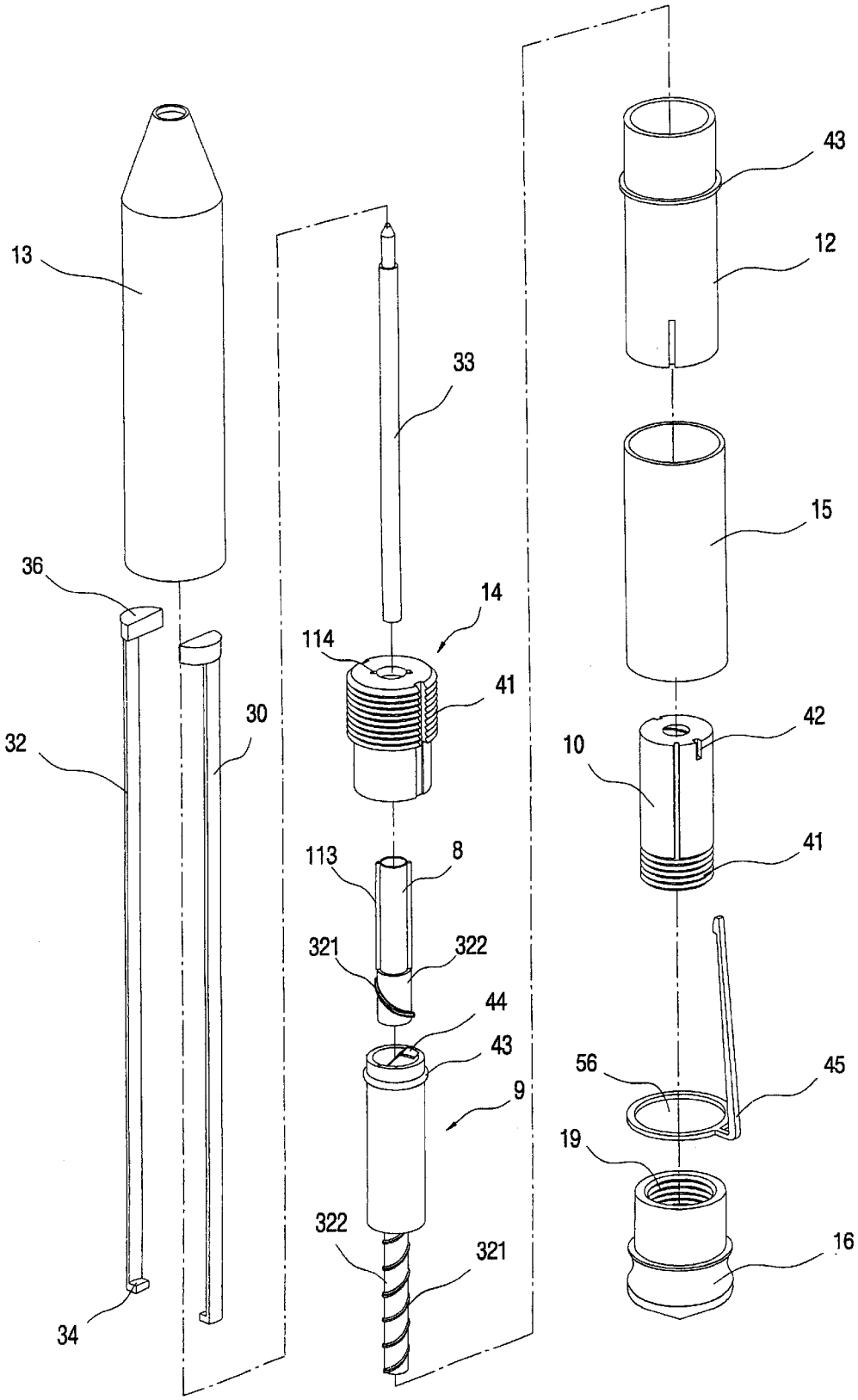
FIG. 34 is an exploded perspective view showing the construction of the hand-held multipurpose casing of FIG. 33.

FIG. 31 is a sectional view of a hand-held multipurpose casing, having a screw-type actuating unit and used as a writing instrument casing with an automatically operated cartridge cover set within the casing, in accordance with the ninth embodiment of the present invention. FIG. 32 is an exploded perspective view showing the construction of the hand-held multipurpose casing of FIG. 31. FIG. 33 is a sectional view of a hand-held multipurpose casing, having a screw-type actuating unit and used as a writing instrument casing with a ballpoint pen cartridge, in accordance with the tenth embodiment of the present invention. FIG. 34 is an exploded perspective view showing the construction of the hand-held multipurpose casing of FIG. 33.

In the ninth embodiment of FIGS. 31 and 32, the general shape of the casing remains the same as that described for the embodiment of FIGS. 9 and 10, but two protective cover members 30 and 32 axially extend within the casing at diametrically opposite positions. The bent projection 34 of each of the two cover members 30 and 32 is fixedly held in the slot 42 of the cap rod 10, and so the two cover members 30 and 32 are movable along with the cap rod 10.

In the tenth embodiment of FIGS. 33 and 34, the general shape of the casing remains the same as that described for the embodiment of FIGS. 11 and 12, but two protective cover members 30 and 32 axially extend within the casing.

The two cover members 30 and 32 are fixedly held on the cap rod 10, and so the two cover members 30 and 32 are movable along with the cap rod 10.

Figure 35:
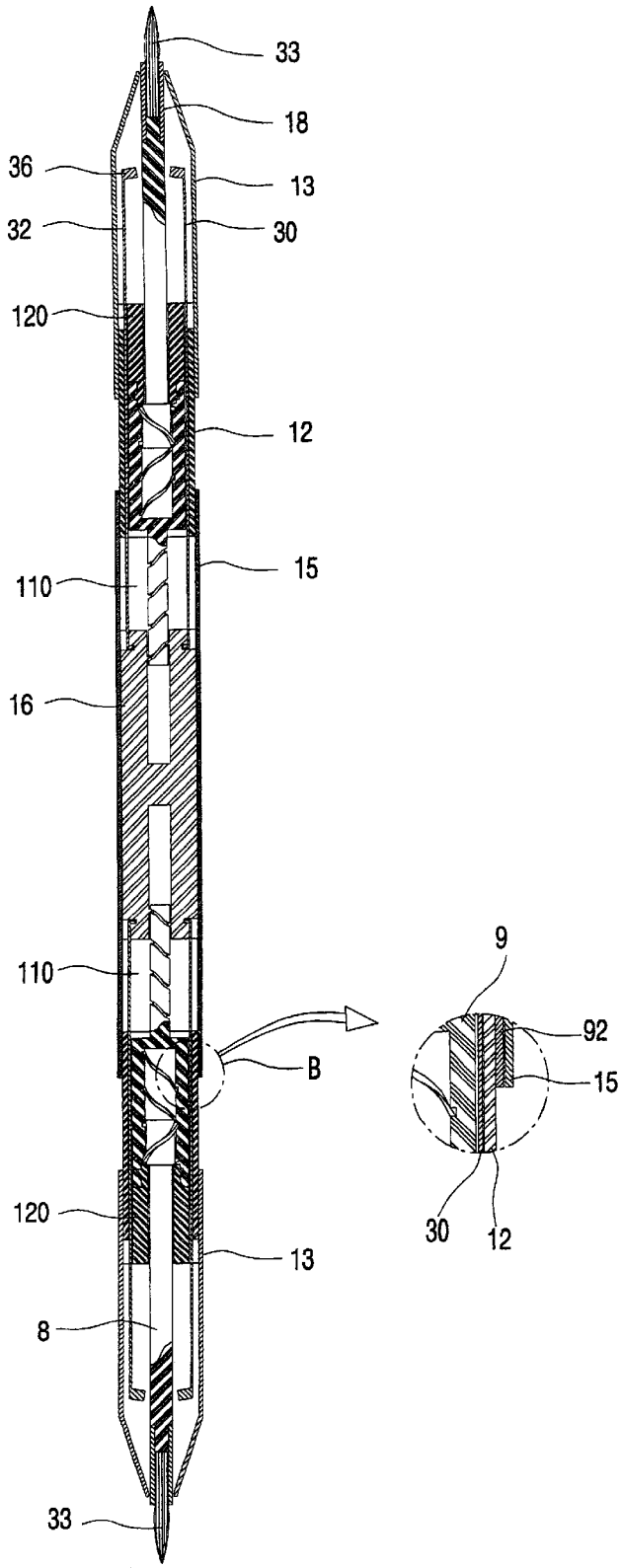
FIG. 35 is a sectional view of a hand-held multipurpose casing, having two screw-type actuating units at opposite end portions of the casing and used as a makeup brush casing, in accordance with the eleventh embodiment of the present invention.
Figure 36:
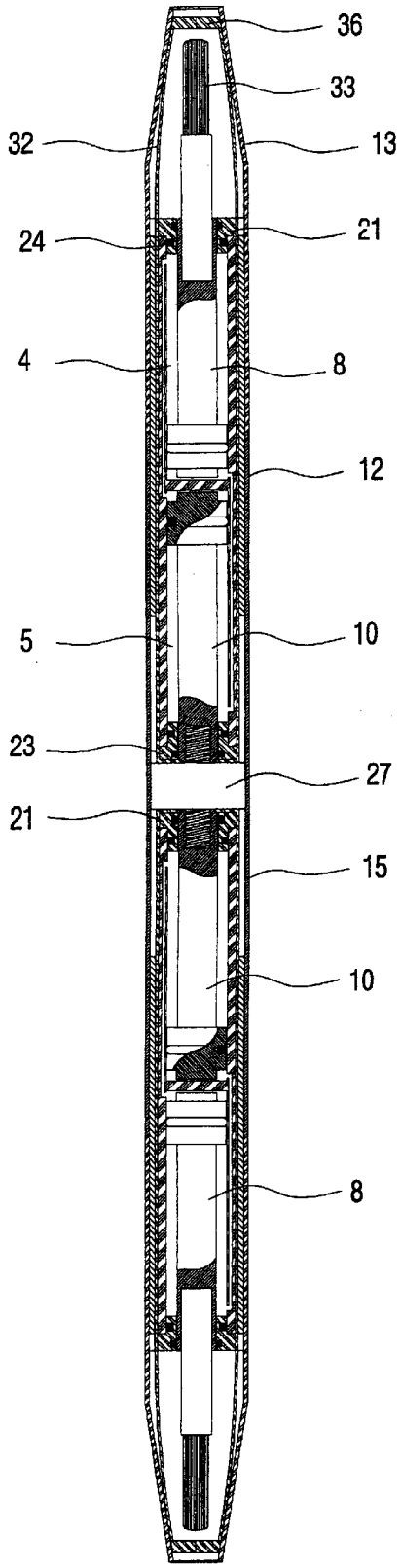
FIG. 36 is a sectional view of a hand-held multipurpose casing, having two cylinder-type actuating units set within opposite end portions of the casing and used as a makeup brush casing, in accordance with the twelfth embodiment of the present invention.
Figure 37:
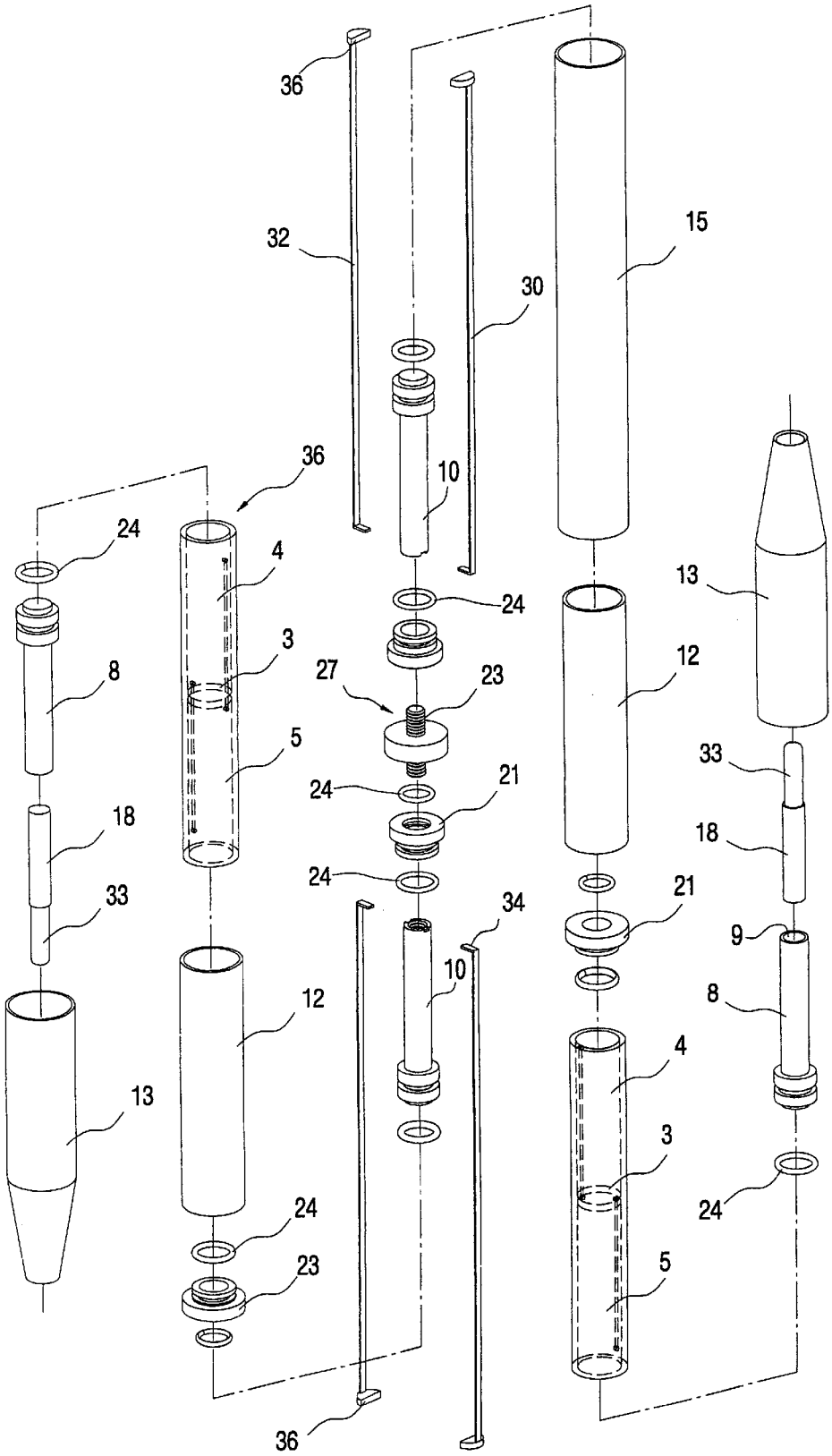
FIG. 37 is an exploded perspective view showing the construction of the hand-held multipurpose casing of FIG. 36.

FIG. 35 is a sectional view of a hand-held multipurpose casing, having two screw-type actuating units at opposite end portions of the casing and used as a makeup brush casing, in accordance with the eleventh embodiment of the present invention. FIG. 36 is a sectional view of a hand-held multipurpose casing, having two cylinder-type actuating units set within opposite end portions of the casing and used as a makeup brush casing, in accordance with the twelfth embodiment of the present invention. FIG. 37 is an exploded perspective view showing the construction of the hand-held multipurpose casing of FIG. 36.

In the eleventh embodiment of FIG. 35, the general shape of the casing, comprising a packing plug 120, two protective cover members 30 and 32, three barrels 12, 13 and 15, a cylindrical slider 92, and a brush holder 18, remains the same as that described for the embodiment of FIG. 19, but the structure of both the rear part of the rotatable rod 110 and the front part of the cap 16 is altered. The structural alteration of both the rod 110 and the cap 16 generally remains the same as that described for the embodiment of FIG. 21, but two screw-type actuating units are symmetrically provided within opposite end portions of the casing.

That is, in this eleventh embodiment, the actuating unit for converting the axial linear movement of the cap 16 into a rotating action of the rotatable rod 110 is altered by making the rotatable rod 110 having a simple hollow cylindrical shape without the longitudinal actuating part 112. The above rotatable rod 110 has internal and external spiral threads on its internal and external surfaces, with the spiral directions of the two spiral threads being opposite to each other.

Since the rotatable rod 110 of this embodiment has such a simple cylindrical shape, the external spiral thread has a larger diameter. In order to allow the two projections of the cap 16 to precisely engage with the external spiral thread of the rod 110, the interior surface of the cap 16 is stepped to enlarge the inner diameter of the cap 16, with the two projections being formed on the stepped internal surface of the cap 16 at a front portion.

In this embodiment, two actuating units, individually having the above-mentioned construction, are symmetrically provided at opposite ends of one cap 16, and so the casing may be provided with two makeup brushes actuated by the two actuating units. Of course, the casing of this embodiment may be provided with two points of pen cartridges in place of the two makeup brushes. In addition, the casing may have a point of a pen cartridge actuated by one actuating unit and a makeup brush actuated by the other actuating unit.

The eleventh embodiment is formed by altering the construction of the embodiment of FIG. 21, but it should be understood that the other embodiments of this invention may be changed in its construction to have two actuating units.

In the twelfth embodiment of FIGS. 36 and 37, the casing has two cylinder-type actuating units. In this embodiment, two cap rods 10 are oppositely positioned within the casing at a middle portion while being connected to each other by a connector 27. The external surface of this connector 27 is fixed to the internal surface of a movable barrel 15 of the casing, thus allowing the two cap rods 10 to be movable along with the barrel 15 in opposite directions.

In order to connect the two cap rods 10 to each other by the connector 27, the facing ends of the two cap rods 10 are individually provided with an internally threaded hole. Two bolts 23 are formed at opposite end surfaces of the connector 27, and are tightened to the internally threaded holes of the two cap rods 10, thus integrating the two cap rods 10 with the opposite ends of the connector 27.

Two protective cover members 30 and 32 are held on each end of the connector 27 and axially extend to be operated in conjunction with an associated actuating unit. In each actuating unit of the twelfth embodiment, the thrust rod 8 is movable in a direction opposite to a moving direction of the cap rod 10, while the two cover members 30 and 32 are movable in the same direction as that of the moving direction of the cap rod 10.

During an operation of the casing according to the twelfth embodiment, compressed air within the cylinder 2 of each actuating unit of the casing flows in the same manner as that described for the embodiment of FIGS. 27 to 30, and further explanation is thus not deemed necessary.

On the other hand, each of the two cover members 30 and 32 comprises a longitudinal guide part, with a cover part 36 and a bent projection 34 being formed at opposite ends of the longitudinal guide part.

Of course, it should be understood that the casing of this embodiment may be provided with a stop groove 44, a guide projection 46 and a guide groove 47 in the same manner as that described for the embodiment of FIGS. 24 to 26.

As described above, the present invention provides a hand-held multipurpose casing, having a cylinder-type or screw-type actuating unit for reversibly extending a functional tipped device housed within the casing, for example, a ballpoint pen cartridge or a makeup brush. This hand-held multipurpose casing has a cylinder-type or screw-type actuating unit capable of reversibly extending such a functional tipped device. The casing of this invention is thus reduced in the number of parts and has a simple construction, thereby being easily produced and repaired while reducing the production and repair cost and conserving labor. This casing also allows a user to purchase it at low cost.

Different from conventional casings for such makeup brushes or writing instruments, it is not necessary for the casing of this invention to have a removable separate cap, but an automatically operated protective cover is set within the casing. The casing of this invention thus saves a user from the inconvenience of losing a conventional removable cap, and the inconvenience of being stained with cosmetics of the makeup brush. Due to the protective cover, the interior of the casing of this invention is effectively protected from foreign substances, such as dust. Since the protective cover is set within the casing and is automatically operated in response to an axial movement of a rear barrel relative to a middle barrel, it is possible for the user to easily operate the casing with one hand. The casing of this invention is less likely to be broken or damaged since it has a simple construction, and so it is usable for a desired lengthy period of time and is recyclable as desired.

The casing of this invention is preferably usable as a casing for makeup brushes or a casing for writing instruments, such as ballpoint pens.

In a detailed description, the casing of this invention is reduced in the number of parts, and is easily assembled and disassembled when necessary. Due to the protective cover set within the casing, the interior of the casing is less likely to become contaminated with foreign substances, such as dust. The casing is also less likely to become frictionally damaged on its parts. The actuating unit smoothly extends or retracts a makeup brush or a point of a writing instrument by an opposite directional axial movement of a rear barrel along with a cap relative to a middle barrel.

It is also possible to press the cap against a support surface, such as the top surface of a desk, to fully retract the makeup brush or the point into the casing. The retraction of the makeup brush or the point into the casing can be accomplished by using one hand. In addition, the casing of this invention is less likely to be broken or damaged since it has a simple construction, and so it is usable for a desired lengthy period of time and is recyclable as desired.

Due to a cylindrical slider set between the middle and rear barrels, the external surface of the middle barrel is protected from frictional damage, such as scratching, during an axial movement of the rear barrel on the middle barrel. The above slider also allows the rear barrel to smoothly move on the middle barrel.

Since the rear barrel is integrated with the cap, the casing is adjustable in its length as desired. That is, when the rear barrel along with the cap is fully moved backward on the middle barrel, the casing has a maximum length. On the other hand, the casing has a minimum length when the rear barrel is fully moved forward on the middle barrel.

In the screw-type actuating unit of the casing according to the invention, the spiral direction of an external spiral thread of a thrust rod is opposite to that of the external spiral thread of a rotatable rod, and so the parts of the actuating unit are smoothly operated while being less likely to be broken.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A hand-held multipurpose casing, comprising a front barrel having a front opening; a middle barrel fixedly fitted into a rear end portion of said front barrel at its front end portion; a rear barrel movably fitted over a rear end portion of said middle barrel at its front end portion so as to be axially movable on the middle barrel; a functional tipped device housed within said casing so as to be axially movable within the casing in response to an axial movement of the rear barrel, thus being extended or retracted from or into the front opening of said front barrel; and an actuating unit used for axially moving the functional tipped device in response to the axial movement of the rear barrel, thus extending or retracting the functional tipped device from or into the front opening of said front barrel, wherein said actuating unit comprises:

a rotatable rod having both an internal spiral thread at its front end portion and an external spiral thread at its rear end portion, with the spiral directions of the internal and external spiral threads being opposite to each other;

a thrust rod holding said functional tipped device at its front end and having an external spiral thread at its rear end portion, and movably engaging with the rotatable rod through a screw-type engagement between the external spiral thread of the thrust rod and the internal spiral thread of the rotatable rod; and a cap rod having an internal spiral thread at its front end portion, and movably engaging with the rotatable rod through a screw-type engagement between the internal spiral thread of the cap rod and the external spiral thread of the rotatable rod, said cap rod also having both an external thread on its external surface at a rear end portion and a guide groove axially formed along the external surface of said cap rod.

2. The hand-held multipurpose casing according to claim 1, further comprising two protective cover members having the same construction, said two cover members individually comprising a longitudinal guide part, with both a cover part and a bend projection formed at opposite ends of the guide part, said two cover members being housed within the casing and being movable along with the rear barrel in the same direction as that of the rear barrel, thus selectively closing or opening the front opening of said front barrel.

3. The hand-held multipurpose casing according to claim 1 or 2, wherein said actuating unit further comprises a centrally and axially holed packing plug, with an external thread being formed on an external surface of said packing plug at a front end portion and two guide grooves being axially formed on an internal surface of said plug at diametrically opposite positions, and movably receiving the thrust rod therein.

4. The hand-held multipurpose casing according to claim 3, wherein said packing plug is fixedly set within the front barrel through a screw-type engagement of the external thread of the packing plug with an internal thread of the front barrel.

5. The hand-held multipurpose casing according to claim 3, wherein said rotatable rod has an external fitting ring on its external surface, said fitting ring engaging with an annular fitting groove formed on the internal surface of said packing plug, thus allowing the rotatable rod to be rotatable within the packing plug so as to move the thrust rod in an axial direction.

6. The hand-held multipurpose casing according to claim 1 or 2, wherein a stop groove is formed at a front end of the internal spiral thread of said rotatable rod for preventing an undesired movement of the thrust rod.

7. The hand-held multipurpose casing according to claim 1 or 2, wherein said thrust rod has an external thread at its front end, and said functional tipped device has an internally threaded hole at its rear end and is mounted to the external thread of the thrust rod at the internally threaded hole.

8. The hand-held multipurpose casing according to claim 1 or 2, wherein a cap, having an internally threaded opening, is tightened to the external thread of the cap rod at its internally threaded opening, thus being integrated with the cap rod.

9. The hand-held multipurpose casing according to claim 1 or 2, wherein said thrust rod is provided with two axial guide rails on its external surface at diametrically opposite positions, said guide rails movably engaging with two guide grooves of a packing plug, thus allowing the thrust to be axially movable.

10. The hand-held multipurpose casing according to claim 1 or 2, wherein said middle barrel has an axial guide projection on its internal surface at a lower portion, and movably engages with said guide groove of the cap rod at the guide projection, thus being prevented from being rotated around the cap rod.

11. The hand-held multipurpose casing according to claim 1 or 2, wherein a sharpened holder is formed within the thrust rod, and holds a rear end of the functional tipped device.

12. The hand-held multipurpose casing according to claim 1 or 2, wherein said functional tipped device is a ballpoint pen cartridge normally biased by a coil spring.

13. The hand-held multipurpose casing according to claim 1 or 2, wherein said functional tipped device is a writing instrument selected from the group consisting of a pencil, ballpoint pen cartridge, and a felt pen cartridge.

14. The hand-held multipurpose casing according to claim 1 or 2, wherein said functional tipped device is selected from the group consisting of crayons, and painting brushes.

* * * * *